US006543538B2

(12) United States Patent
Tolman et al.

(10) Patent No.: US 6,543,538 B2
(45) Date of Patent: Apr. 8, 2003

(54) METHOD FOR TREATING MULTIPLE WELLBORE INTERVALS

(75) Inventors: Randy C. Tolman, Spring, TX (US); Kris J. Nygaard, Houston, TX (US); Abdel Wadood M. El-Rabaa, Houston, TX (US); William A. Sorem, Katy, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/891,673

(22) Filed: Jun. 25, 2001

(65) Prior Publication Data

US 2002/0007949 A1 Jan. 24, 2002

Related U.S. Application Data

(60) Provisional application No. 60/219,229, filed on Jul. 18, 2000.

(51) Int. Cl.[7] ..... E21B 43/26; E21B 43/04; E21B 43/17

(52) U.S. Cl. ..... 166/284; 166/278; 166/297; 166/308

(58) Field of Search ..... 166/284, 305.1, 166/306, 307, 308, 373, 381, 386, 278, 297

(56) References Cited

U.S. PATENT DOCUMENTS

| | | | | |
|---|---|---|---|---|
| 2,067,408 | A | 1/1937 | Morris | 102/4 |
| 2,925,775 | A | 2/1960 | McKee | 102/20 |
| 2,968,243 | A | 1/1961 | Turechek | 102/20 |
| 2,986,214 | A | 5/1961 | Wiseman, Jr. et al. | 166/55 |
| 3,028,914 | A | 4/1962 | Flickinger | 166/42 |
| 3,111,988 | A | 11/1963 | Davis et al. | 166/42 |

(List continued on next page.)

OTHER PUBLICATIONS

Stipp, Louis C. and Williford, R.A. *Pseudolimited Entry: A Sand Fracturing Technique for Simultaneous Treatment of Multiple Pays,* Journal of Petorleum Technology (May 1968) pp. 457–462.

Williams, B.B., Nieto, G., Graham, H.L., and Leibach R.E. *A Staged Fracturing Treatment for Multisand Intervals,* Journal of Petroleum Technology (Aug. 1973) pp. 897–904.

Von Albrecht, C., Diaz, B., Salathiel, W.M., and Nierode, D.E. *Stimulation of Asphaltic Deep Wells and Shallow Wells in Lake Maracaibo, Venezuela, 10th World Petroleum Congress,* PD7, Bucharest, Romania (1979) pp. 55–62.

Warpinski, N.R., Branagan, P.T., Lorenz, J.C., Northrop, D.A., and Frohne, K.H. *Fracturing and Testing Case Study of Paludal, Tight, Lenticular Gas Sands, SPE/DOE 1985 Low Permeability Gas Reservoirs,* Denver, Colorado Paper No. SPE/DOE 13876 (May 9–22, 1985) pp. 267–278.

Sattler, A.R., Hudson, P.J., Raible, C.J., Gall, B.L., and Maloney D.R. *Laboratory Studies for the Design and Analysis of hydraulic Fractured Stimulations in Lenticular, Tight Gas Reservoirs, Unconventional Gas Technology Symposium,* Louisville, KY, Paper No. SPE 15245 (May 18–21, 1986) pp. 437–447.

Cipolla, Craig L. *Hydraulic Fracture Technology in the Ozona Canyon and Penn Sands, Permian Basin Oil & Gas Recovery Conference,* Midland, Texas, Paper No. SPE 35196 (Mar. 27–29, 1996) pp. 455–466.

(List continued on next page.)

*Primary Examiner*—David Bagnell
*Assistant Examiner*—Jennifer H Gay

(57) ABSTRACT

This invention provides a method for treating multiple intervals in a wellbore by perforating at least one interval then treating and isolating the perforated interval(s) without removing the perforating device from the wellbore during the treatment or isolation. The invention can be applied to hydraulic fracturing with or without proppant materials as well as to chemical stimulation treatments.

46 Claims, 17 Drawing Sheets

U.S. PATENT DOCUMENTS

| | | | | | |
|---|---|---|---|---|---|
| 3,118,501 | A | | 1/1964 | Kenley | 166/55.4 |
| 3,366,188 | A | | 1/1968 | Hicks | 175/4.6 |
| 3,427,652 | A | | 2/1969 | Seay | 166/250 |
| 3,429,384 | A | | 2/1969 | Shore | 175/4.6 |
| 3,547,198 | A | | 12/1970 | Slusser | 166/284 |
| 3,662,833 | A | | 5/1972 | Kisling, III | 166/314 |
| 3,712,379 | A | | 1/1973 | Hill | 166/297 |
| 3,739,723 | A | | 6/1973 | Hakala | 102/20 |
| 3,874,461 | A | | 4/1975 | Cocanower | 175/4.6 |
| 4,101,425 | A | * | 7/1978 | Young et al. | 166/307 |
| 4,102,401 | A | | 7/1978 | Erbstoesser | 166/284 |
| 4,111,314 | A | | 9/1978 | Savanick et al. | 299/4 |
| 4,137,182 | A | | 1/1979 | Golinkin | 252/8.55 R |
| 4,139,060 | A | | 2/1979 | Muecke et al. | 166/281 |
| 4,244,425 | A | | 1/1981 | Erbstoesser | 166/284 |
| 4,415,035 | A | | 11/1983 | Medlin et al. | 166/308 |
| 4,637,468 | A | | 1/1987 | Derrick | 166/297 |
| 4,671,352 | A | | 6/1987 | Magee, Jr. et al. | 166/186 |
| 4,702,316 | A | | 10/1987 | Chung et al. | 166/272 |
| 4,776,393 | A | | 10/1988 | Forehand et al. | 166/55.1 |
| 4,809,781 | A | | 3/1989 | Hoefner | 166/273 |
| 4,867,241 | A | | 9/1989 | Strubhar | 166/308 |
| 5,025,861 | A | | 6/1991 | Huber et al. | 166/297 |
| 5,131,472 | A | | 7/1992 | Dees et al. | 166/308 |
| 5,161,618 | A | | 11/1992 | Jones et al. | 166/308 |
| 5,205,360 | A | * | 4/1993 | Price | 166/308 |
| 5,309,995 | A | | 5/1994 | Gonzalez et al. | 166/284 |
| 5,314,019 | A | | 5/1994 | Honarpour | 166/270 |
| 5,353,875 | A | | 10/1994 | Schultz et al. | 166/297 |
| 5,390,741 | A | | 2/1995 | Payton et al. | 166/284 |
| 5,485,882 | A | | 1/1996 | Bailey et al. | 166/284 |
| 5,513,703 | A | | 5/1996 | Mills et al. | 166/55.1 |
| 5,579,844 | A | | 12/1996 | Rebardi et al. | 166/296 |
| 5,598,891 | A | | 2/1997 | Snider et al. | 166/308 |
| 5,669,448 | A | | 9/1997 | Minthorn et al. | 166/308 |
| 5,704,426 | A | | 1/1998 | Rytlewski et al. | 166/297 |
| 5,755,286 | A | | 5/1998 | Ebinger | 166/281 |
| 5,803,178 | A | | 9/1998 | Cain | 166/306 |
| 5,865,252 | A | | 2/1999 | van Petegem et al. | 166/297 |
| 5,890,536 | A | | 4/1999 | Nierode et al. | 166/284 |
| 5,934,377 | A | | 8/1999 | Savage | 166/281 |
| 5,947,200 | A | | 9/1999 | Montgomery | 166/281 |
| 5,954,133 | A | | 9/1999 | Ross | 166/297 |
| 5,990,051 | A | | 11/1999 | Ischy et al. | 507/204 |
| 5,996,687 | A | | 12/1999 | Pringle et al. | 166/66.6 |
| 6,186,230 | B1 | | 2/2001 | Nierode | 166/250.1 |
| 6,189,621 | B1 | | 2/2001 | Vail, III | 166/385 |
| 6,257,332 | B1 | | 7/2001 | Vidrine et al. | 166/250.15 |
| 6,296,066 | B1 | | 10/2001 | Terry et al. | 175/92 |
| 6,394,184 | B2 | * | 5/2002 | Tolman et al. | 166/120 |

OTHER PUBLICATIONS

Cipolla, Craig L.and Woods, Mike C. *A Statistical Approach to Infill Drilling Studies: Case history of the Ozona Canyon Sands, Gas Technology Conference,* Calgary, Alberta, Canada Paper No. SPE 35628 (Apr. 28–May 1, 1996) pp. 493–497.

Webster, K.R., Goins Jr., w.C. and Berry, S.C. *A Continuous Multistage Fracturing Technique,* Journal of Petroleum Technology (Jun., 1965) pp. 619–625.

Kordziel, Walter R., Rowe, Wayne, Dolan, V.B., and Ritger, Scott D. *A Case Study of Integrating Well–Logs and a Pseudo 3D Multi–Layer Frac Model to Optimize Exploitation of Tight Lenticular Gas Sands, European Petroleum Conference,* Milan Italy, Paper No. SPE 36886 (Oct. 22–24, 1996) pp. 129–141.

Kuuskraa, Vello A., Prestridge, Andrew L., and Hansen, John T. *Advanced Technologies for Producing Massively Stacked Lenticular Sands, Gas Technology Conference,* Calgary, Alberta, Canada, Paper No. SPE 35630 (Apr. 28–May 1, 1996) pp. 505–514.

Bennion, D.B., Thomas, F.B., and Bietz, R.F. *Low Permeability Gas Reservoirs: Problems, Opportunities and Solutions for Drilling, Completion, Stimulation and Production, Gas Technology Conference,* Calgary, Alberta, Canada, Paper No. SPE 35577 (Apr. 28–May 1, 1996) pp. 117–131.

* cited by examiner

METHOD FOR TREATING MULTIPLE WELLBORE INTERVALS

This application claims the benefit of U.S. Provisional Application No. 60/219,229 filed Jul. 18, 2000.

FIELD OF THE INVENTION

This invention relates generally to the field of perforating and treating subterranean formations to increase the production of oil and gas therefrom. More specifically, the invention provides a method for perforating and treating multiple intervals without the necessity of discontinuing treatment between steps or stages.

BACKGROUND OF THE INVENTION

When a hydrocarbon-bearing, subterranean reservoir formation does not have enough permeability or flow capacity for the hydrocarbons to flow to the surface in economic quantities or at optimum rates, hydraulic fracturing or chemical (usually acid) stimulation is often used to increase the flow capacity. A wellbore penetrating a subterranean formation typically consists of a metal pipe (casing) cemented into the original drill hole. Typically, lateral holes (perforations) are shot through the casing and the cement sheath surrounding the casing to allow hydrocarbon flow into the wellbore and, if necessary, to allow treatment fluids to flow from the wellbore into the formation.

Hydraulic fracturing consists of injecting viscous fluids (usually shear thinning, non-Newtonian gels or emulsions) into a formation at such high pressures and rates that the reservoir rock fails and forms a plane, typically vertical, fracture (or fracture network) much like the fracture that extends through a wooden log as a wedge is driven into it. Granular proppant material, such as sand, ceramic beads, or other materials, is generally injected with the later portion of the fracturing fluid to hold the fracture(s) open after the pressures are released. Increased flow capacity from the reservoir results from the more permeable flow path left between grains of the proppant material within the fracture (s). In chemical stimulation treatments, flow capacity is improved by dissolving materials in the formation or otherwise changing formation properties.

Application of hydraulic fracturing as described above is a routine part of petroleum industry operations as applied to individual target zones of up to about 60 meters (200 feet) of gross, vertical thickness of subterranean formation. When there are multiple or layered reservoirs to be hydraulically fractured, or a very thick hydrocarbon-bearing formation (over about 60 meters), then alternate treatment techniques are required to obtain treatment of the entire target zone. The methods for improving treatment coverage are commonly known as "diversion" methods in petroleum industry terminology.

When multiple hydrocarbon-bearing zones are stimulated by hydraulic fracturing or chemical stimulation treatments, economic and technical gains are realized by injecting multiple treatment stages that can be diverted (or separated) by various means, including mechanical devices such as bridge plugs, packers, down-hole valves, sliding sleeves, and baffle/plug combinations; ball sealers; particulates such as sand, ceramic material, proppant, salt, waxes, resins, or other compounds; or by alternative fluid systems such as viscosified fluids, gelled fluids, or foams, or other chemically formulated fluids; or using limited entry methods. These and all other methods for temporarily blocking the flow of fluids into or out of a given set of perforations will be referred to herein as "diversion agents."

In mechanical bridge plug diversion, for example, the deepest interval is first perforated and fracture stimulated, then the interval is isolated mechanically and the process is repeated in the next interval up. Assuming ten target perforation intervals, treating 300 meters (1,000 feet) of formation in this manner would typically require ten jobs over a time interval of ten days to two weeks with not only multiple fracture treatments, but also multiple and separate perforating and bridge plug running operations. At the end of the treatment process, a wellbore clean-out operation would be required to remove the bridge plugs and put the well on production. The major advantage of using bridge plugs or other mechanical diversion agents is high confidence that the entire target zone is treated. The major disadvantages are the high cost of treatment resulting from multiple separate trips into and out of the wellbore and the risk of complications resulting from so many separate operations on the well. For example, a bridge plug can become stuck in the casing and need to be drilled out at great expense. A further disadvantage is that the required wellbore clean-out operation may damage some of the successfully fractured intervals.

One alternative to using bridge plugs is filling the just fractured interval of the wellbore with fracturing sand, commonly referred to as the Pine Island technique. The sand column essentially plugs off the already fractured interval and allows the next interval to be perforated and fractured independently. The primary advantage is elimination of the problems and risks associated with bridge plugs. The disadvantages are that the sand plug does not give a perfect hydraulic seal and it can be difficult to remove from the wellbore at the end of all the fracture stimulation treatments. Unless the well's fluid production is strong enough to carry the sand from the wellbore, the well may still need to be cleaned out with a work-over rig or coiled tubing unit. As before, additional wellbore operations increase costs, mechanical risks, and risks of damage to the fractured intervals.

Another method of diversion involves the use of particulate materials, granular solids that are placed in the treating fluid to aid diversion. As the fluid is pumped, and the particulates enter the perforations, a temporary block forms in the zone accepting the fluid if a sufficiently high concentration of particulates is deployed in the flow stream. The flow restriction then diverts fluid to the other zones. After the treatment, the particulate is removed by produced formation fluids or by injected wash fluid, either by fluid transport or by dissolution. Commonly available particulate diverter materials include benzoic acid, napthalene, rock salt (sodium chloride), resin materials, waxes, and polymers. Alternatively, sand, proppant, and ceramic materials, could be used as particulate diverters. Other specialty particulates can be designed to precipitate and form during the treatment.

Another method for diverting involves using viscosified fluids, viscous gels, or foams as diverting agents. This method involves pumping the diverting fluid across and/or into the perforated interval. These fluid systems are formulated to temporarily obstruct flow to the perforations due to viscosity or formation relative permeability increases; and are also designed so that at the desired time, the fluid system breaks down, degrades, or dissolves (with or without adding chemicals or other additives to trigger such breakdown or dissolution) such that flow can be restored to or from the perforations. These fluid systems can be used for diversion of matrix chemical stimulation treatments and fracture treatments. Particulate diverters and/or ball sealers are sometimes incorporated into these fluid systems in efforts to enhance diversion.

Another possible diversion technique is the "limited-entry" diversion method in which the entire target zone of the formation to be treated is perforated with a very small number of perforations, generally of small diameter, so that the pressure loss across those perforations during pumping promotes a high, internal wellbore pressure. The internal wellbore pressure is designed to be high enough to cause all of the perforated intervals to fracture simultaneously. If the pressure were too low, only the weakest portions of the formation would fracture. The primary advantage of limited entry diversion is that there are no inside-the-casing obstructions like bridge plugs or sand that need to be removed from the well or which could lead to operational problems later. The disadvantage is that limited entry fracturing often does not work well for thick intervals because the resulting fracture is frequently too narrow (the proppant cannot all be pumped away into the narrow fracture and remains in the wellbore), and the initial, high wellbore pressure may not last. As the sand material is pumped, the perforation diameters are often quickly eroded to larger sizes that reduce the internal wellbore pressure. The net result can be that not all of the target zone is stimulated. An additional concern is the potential for flow capacity into the wellbore to be limited by the small number of perforations.

The problems resulting from failure to stimulate the entire target zone or using mechanical methods that pose greater risk and cost as described above can be addressed by using limited, concentrated perforated intervals diverted by ball sealers. The zone to be treated could be divided into sub-zones with perforations at approximately the center of each of those sub-zones, or sub-zones could be selected based on analysis of the formation to target desired fracture locations. The fracture stages would then be pumped with diversion by ball sealers at the end of each stage. Specifically, 300 meters (1,000 feet) of gross formation might be divided into ten sub-zones of about 30 meters (about 100 feet) each. At the center of each 30 meter (100 foot) sub-zone, ten perforations might be shot at a density of three shots per meter (one shot per foot) of casing. A fracture stage would then be pumped with sand-laden fluid followed by ten or more ball sealers, at least one for each open perforation in a single perforation set or interval. The process would be repeated until all of the perforation sets were fractured. Such a system is described in more detail in U.S. Pat. No. 5,890,536 issued Apr. 6, 1999.

Historically, all zones to be treated in a particular job have been perforated prior to pumping treatment fluids, and ball sealers have been employed to divert treatment fluids from zones already broken down or otherwise taking the greatest flow of fluid to other zones taking less, or no, fluid prior to the release of ball sealers. Treatment and sealing theoretically proceeded zone by zone depending on relative breakdown pressures or permeabilities, but problems were frequently encountered with balls prematurely seating on one or more of the open perforations outside the targeted interval and with two or more zones being treated simultaneously.

FIG. 1 illustrates the general concept of using ball sealers as a diversion agent for stimulation of multiple perforation intervals. FIG. 1 shows perforation intervals 32, 33, and 34 of an example well 30. Perforations 36 penetrate wellbore casing 38 and cement sheath 39. In FIG. 1, perforated interval 33 has been stimulated with hydraulic proppant fracture 46 and is in the process of being sealed by ball sealers 12 (in wellbore) and ball sealers 14 (already seated on perforations). Under ideal circumstances, as the ball sealers 12 and ball sealers 14 seal perforation interval 33, the wellbore pressure would rise causing another single perforation interval to break down. This technique presumes that each perforation interval or sub-zone would break down and fracture at sufficiently different pressure so that each stage of treatment would enter only one set of perforations. However, in some instances, multiple perforation intervals may break down at nearly the same pressure so that a single stage of treatment may actually enter multiple intervals and lead to sub-optimal stimulation. Although a method exists to design a multiple-stage ball sealer-diverted fracture treatment so that only one set of perforations is fractured by each stage of fluid pumped, such as that disclosed in U.S. Pat. No. 6,186,230 issued Feb. 13, 2001, the optimum use of this method is dependent on formation characteristics and stimulation job requirements; as such, in some instances it may not be possible to optimally implement the treatment so that only one zone is treated at a time.

The primary advantages of ball sealer diversion are low cost and low risk of mechanical problems. Costs are low because the process can typically be completed in one continuous operation, usually during just a few hours of a single day. Only the ball sealers are left in the wellbore to either flow out with produced hydrocarbons or drop to the bottom of the well in an area known as the rat (or junk) hole. The primary disadvantage is the inability to be certain that only one set of perforations will fracture at a time so that the correct number of ball sealers are dropped at the end of each treatment stage. In fact, optimal benefit of the process depends on one fracture stage entering the formation through only one perforation set and all other open perforations remaining substantially unaffected during that stage of treatment. Further disadvantages are lack of certainty that all of the perforated intervals will be treated and of the order in which these intervals are treated while the job is in progress. In some instances, it may not be possible to control the treatment such that individual zones are treated with single treatment stages.

Other methods have been proposed to address the concerns related to fracture stimulation of zones in conjunction with perforating. These proposals include 1) having a sand slurry in the wellbore while perforating with overbalanced pressure, 2) dumping sand from a bailer simultaneously with firing the perforating charges, and 3) including sand in a separate explosively released container. These proposals all allow for only minimal fracture penetration surrounding the wellbore and are not adaptable to the needs of multi-stage hydraulic fracturing as described herein.

Accordingly, there is a need for a method for individually treating each of multiple intervals within a wellbore while maintaining the economic benefits of multistage treatment. There is also a need for a fracture treatment design method that can economically reduce the risks inherent in the currently available fracture treatment options for hydrocarbon-bearing formations with multiple or layered reservoirs or with thickness exceeding about 60 meters (200 feet).

SUMMARY OF THE INVENTION

This invention provides a method for treatment of multiple perforated intervals so that only one such interval is treated during each treatment stage while at the same time determining the sequence order in which intervals are treated. The inventive method will allow more efficient chemical and/or fracture stimulation of many reservoirs, leading to higher well productivity and higher hydrocarbon recovery (or higher infectivity) than would otherwise have been achieved.

One embodiment of the invention involves perforating at least one interval of the one or more subterranean formations penetrated by a given wellbore, pumping the desired treatment fluid without removing the perforating device from the wellbore, deploying some item or substance in the wellbore to removably block further fluid flow into the treated perforations, and then repeating the process for at least one more interval of subterranean formation.

Another embodiment of the invention involves perforating at least one interval of the one or more subterranean formations penetrated by a given wellbore, pumping the desired treatment fluid without removing the perforating device from the wellbore, actuating a mechanical diversion device in the wellbore to removably block further fluid flow into the treated perforations, and then repeating the process for at least one more interval of subterranean formation.

BRIEF DESCRIPTION OF THE DRAWINGS

The present invention and its advantages will be better understood by referring to the following detailed description and the attached drawings in which.

DETAILED DESCRIPTION OF THE INVENTION

The present invention will be described in connection with its preferred embodiments. However, to the extent that the following description is specific to a particular embodiment or a particular use of the invention, this is intended to be illustrative only, and is not to be construed as limiting the scope of the invention. On the contrary, it is intended to cover all alternatives, modifications, and equivalents that are included within the spirit and scope of the invention, as defined by the appended claims.

Hydraulic fracturing using a treating fluid comprising a slurry of proppant materials with a carrier fluid will be used for many of the examples described herein due to the relatively greater complexity of such operations when compared to fracturing with fluid alone or to chemical stimulation. However, the present invention is equally applicable to chemical stimulation operations which may include one or more acidic or organic solvent treating fluids.

Specifically, the invention comprises a method for individually treating each of multiple intervals within a wellbore in order to enhance either productivity or injectivity. The present invention provides a new method for ensuring that a single zone is treated with a single treatment stage. The invention involves individually and sequentially perforating the desired multiple zones with a perforating device in the wellbore while pumping the multiple stages of the stimulation treatment and deploying ball sealers or other diversion materials and/or actuating mechanical diversion devices to provide precisely controlled diversion of the treatment stages. For the purposes of this application, "wellbore" will be understood to include all sealed equipment above ground level, such as the wellhead, spool pieces, blowout preventers, and lubricator, as well as all below-ground components of the well.

Figure 1:
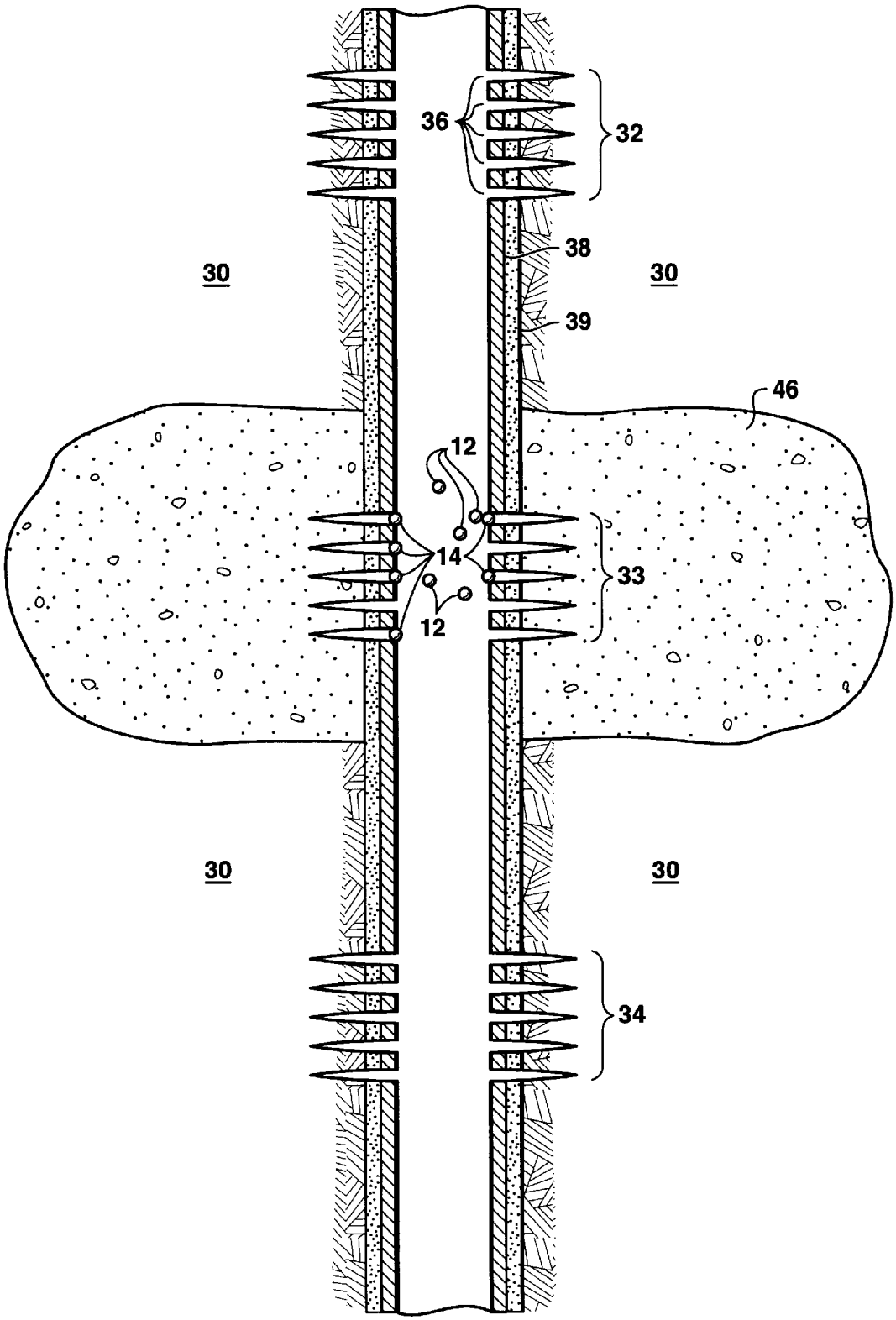
FIG. 1 (Prior Art)
FIG. 1 is a schematic of a wellbore showing ball-sealers being used to seal off a fractured sub-zone in a perforated wellbore.
Figure 2:
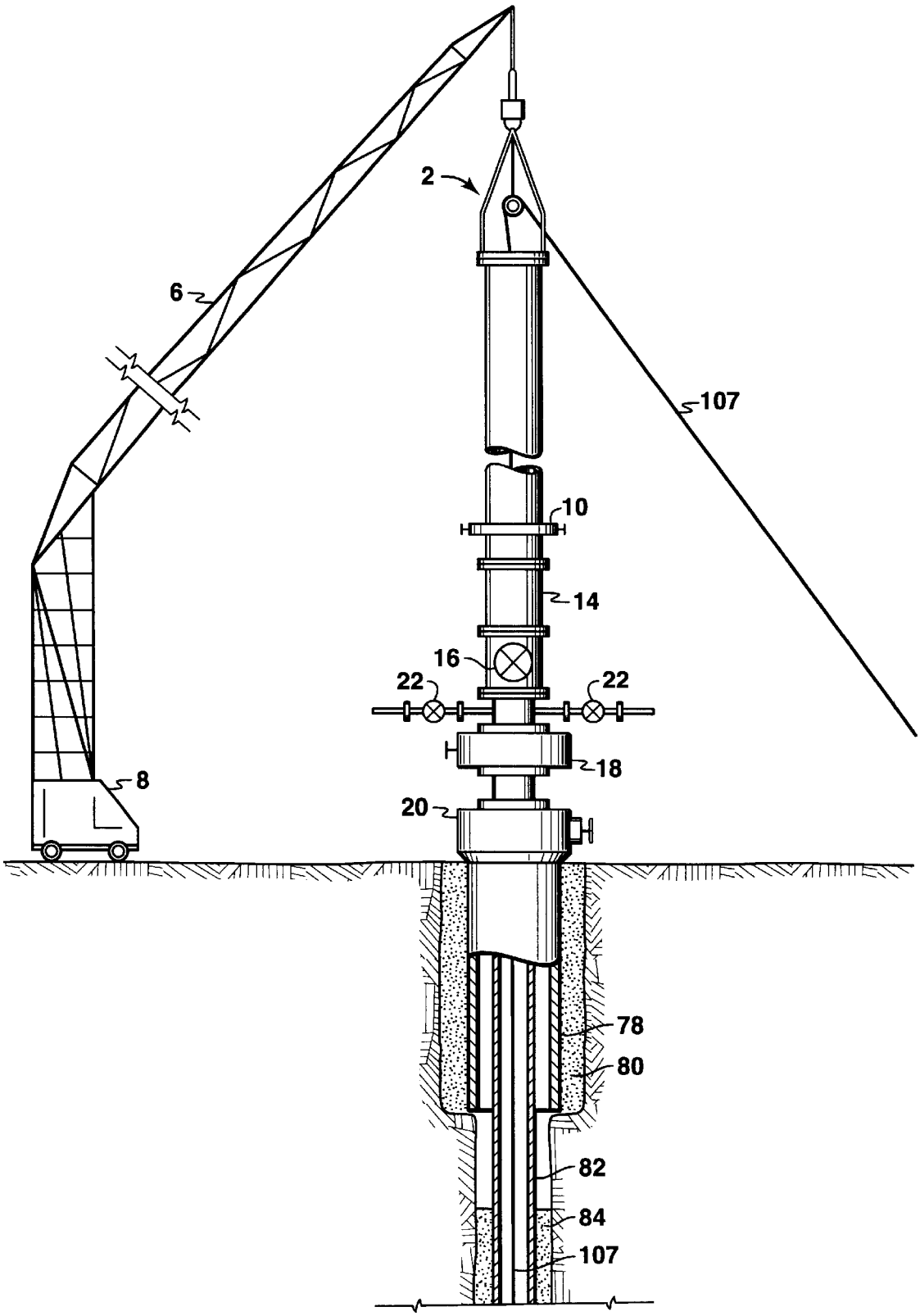
FIG. 2 is an illustration of a representative typical wellbore configuration with peripheral equipment that could be used to support the perforating device when the perforating device is deployed on wireline.

Referring now to FIG. 2, an example of the type of surface equipment that could be utilized in the first preferred embodiment would be a rig up that used a very long lubricator system 2 suspended high in the air by crane arm 6 attached to crane base 8. The wellbore would typically comprise a length of a surface casing 78 partially or wholly within a cement sheath 80 and a production casing 82 partially or wholly within a cement sheath 84 where the interior wall of the wellbore is composed of the production casing 82. The depth of the wellbore would preferably extend some distance below the lowest interval to be stimulated to accommodate the length of the perforating device that would be attached to the end of the wireline 107. Using operational methods and procedures well-known to those skilled in the art of rig-up and installation of wireline tools into a wellbore under pressure, wireline 107 is inserted into the wellbore using the lubricator system 2. Also installed to the lubricator system 2 are wireline blow-out-preventors 10 that could be remotely actuated in the event of operational upsets. The crane base 8, crane arm 6, lubricator system 2, blow-out-preventors 10 (and their associated ancillary control and/or actuation components) are standard equipment components well known to those skilled in the art that will accommodate methods and procedures for safely installing a wireline perforating device in a well under pressure, and subsequently removing the wireline perforating device from a well under pressure.

With readily-available existing equipment, the height to the top of the lubricator system 2 could be approximately one-hundred feet from ground level. The crane arm 6 and crane base 8 would support the load of the lubricator system 2 and any load requirements anticipated for the completion operations In general, the lubricator system 2 must be of length greater than the length of the perforating device to allow the perforating device to be safely deployed in a wellbore under pressure. Depending on the overall length requirements, other lubricator system suspension systems (fit-for-purpose completion/workover rigs) could also be used. Alternatively, to reduce the overall surface height requirements a downhole lubricator system similar to that described in U.S. Pat. No. 6,056,055 issued May 2, 2000 could be used as part of the wellbore design and completion operations.

Also shown in FIG. 2 are several different wellhead spool pieces that may be used for flow control and hydraulic isolation during rig-up operations, stimulation operations, and rig-down operations. The crown valve 16 provides a device for isolating the portion of the wellbore above the crown valve 16 from the portion of the wellbore below the crown valve 16. The upper master fracture valve 18 and lower master fracture valve 20 also provide valve systems for isolation of wellbore pressures above and below their respective locations. Depending on site-specific practices and stimulation job design, it is possible that not all of these isolation-type valves may actually be required or used.

The side outlet injection valves 22 shown in FIG. 2 provide a location for injection of stimulation fluids into the wellbore. The piping from the surface pumps and tanks used for injection of the stimulation fluids would be attached with appropriate fittings and/or couplings to the side outlet injection valves 22. The stimulation fluids would then be pumped into the production casing 82 via this flow path. With installation of other appropriate flow control equipment, fluid may also be produced from the wellbore using the side outlet injection valves 22. The wireline isolation tool 14 provides a means to protect the wireline from direct impingement of proppant-laden fluids injected in to the side outlet injection valves 22.

Figure 3:
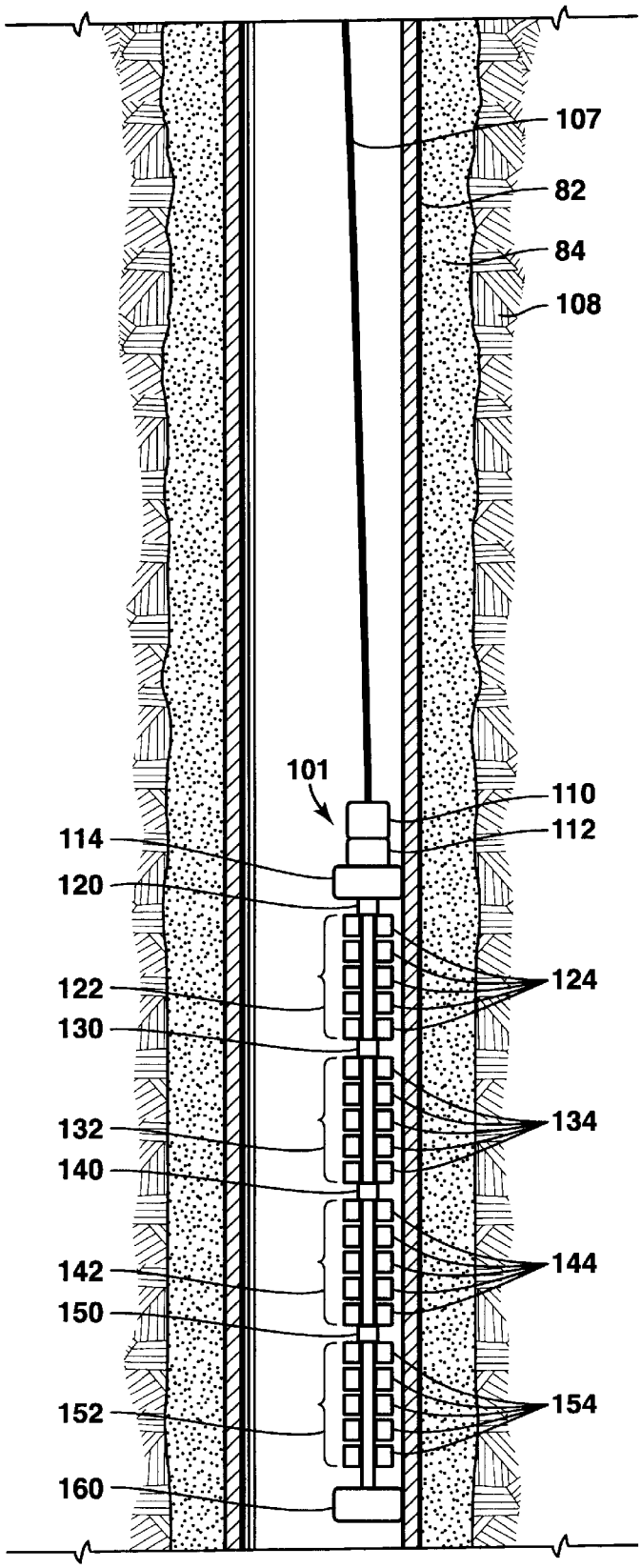
FIG. 3 represents a selectively-fired perforating device suspended by wireline in an unperforated wellbore and positioned at the depth location to be perforated by the first set of selectively-fired perforating charges.

One embodiment of the inventive method, using ball sealers as the diversion agent for this hydraulic fracturing example, involves arranging a perforating device such that it contains multiple sets of charges such that each set can be fired separately by some triggering mechanism. As shown in FIG. 3, a select-fire perforating device 101 is deployed via wireline 107. The select-fire perforating device 101 shown for illustrative purposes in FIG. 3 consists of a rope-socket/shear-release/fishing-neck sub 110, casing collar-locator 112, an upper magnetic decentralizer 114, a lower magnetic decentralizer 160, and four select-fire perforation charge carriers 152, 142, 132, 122. Select-fire perforation charge carrier 152 contains ten perforation charges 154 and is independently fired using the select-fire firing head 150; select-fire perforation charge carrier 142 contains ten perforation charges 144 and is independently fired using the select-fire firing head 140; select-fire perforation charge carrier 132 contains ten perforation charges 134 and is independently fired using the select-fire firing head 130; select-fire perforation charge carrier 122 contains ten perforation charges 124 and is independently fired using the select-fire firing head 120. This type of select-fire perforating device and associated surface equipment and operating procedures are well-known to those skilled in the art of perforating wellbores.

Figure 4:
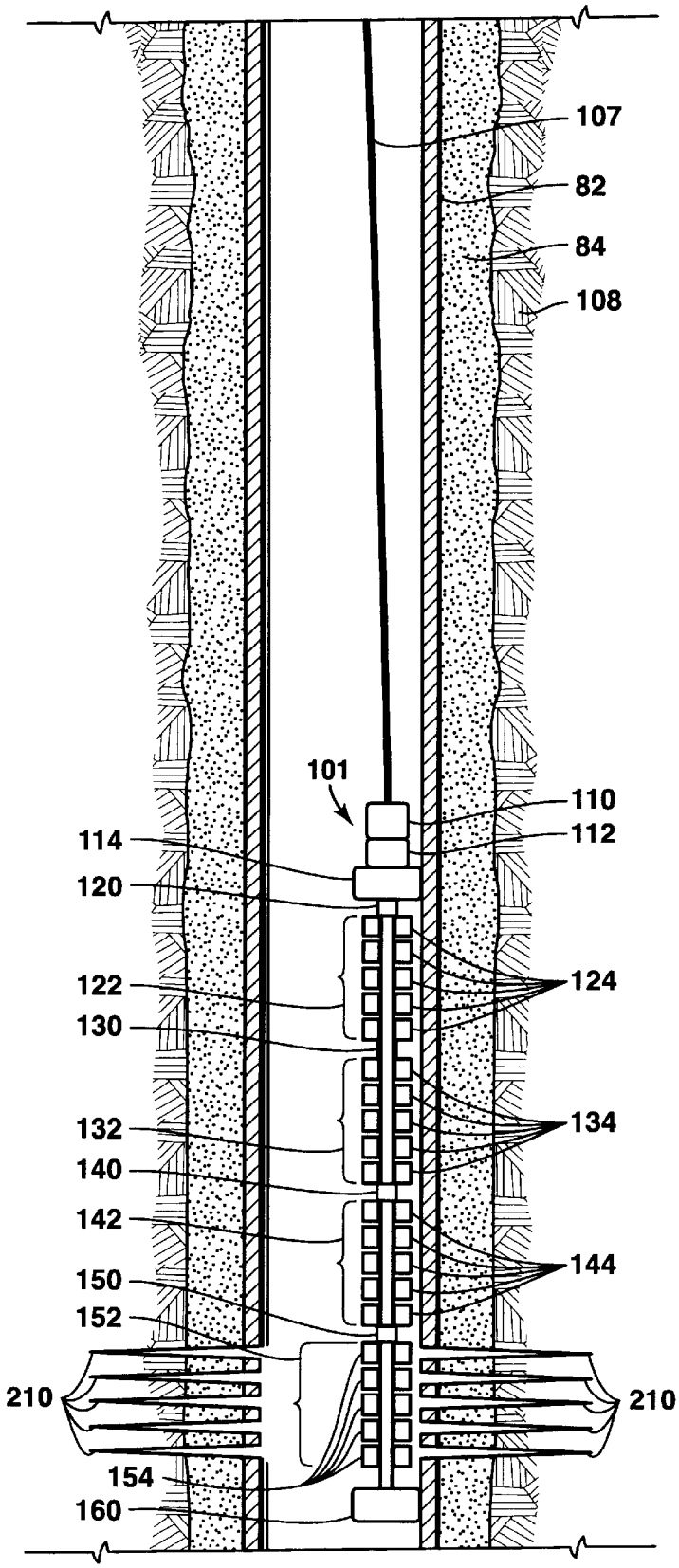
FIG. 4 represents the perforating device and wellbore of FIG. 3 after the first set of selectively-fired perforating charges are fired resulting in perforation holes through the casing and cement sheath and into the formation such that hydraulic communication is established between the wellbore and formation.

As shown in FIG. 3, perforating device 101 would then be positioned in the wellbore with perforation charges 154 at the location of the first zone to be perforated. Positioning of perforating device 101 would be readily performed and accomplished using the casing collar locator 112. Then as illustrated in FIG. 4, the ten perforation charges 154 would be fired to create ten perforation holes 210 that penetrate the production casing 82 and cement sheath 84 to establish a flow path with the first zone to be treated. The perforating device 101 may then be repositioned within the wellbore as appropriate so as not to interfere with the pumping of the treatment and/or the trajectories of the ball sealers, and would preferably be positioned so that perforation charges 144 would be located at the next zone to be perforated.

Figure 5:
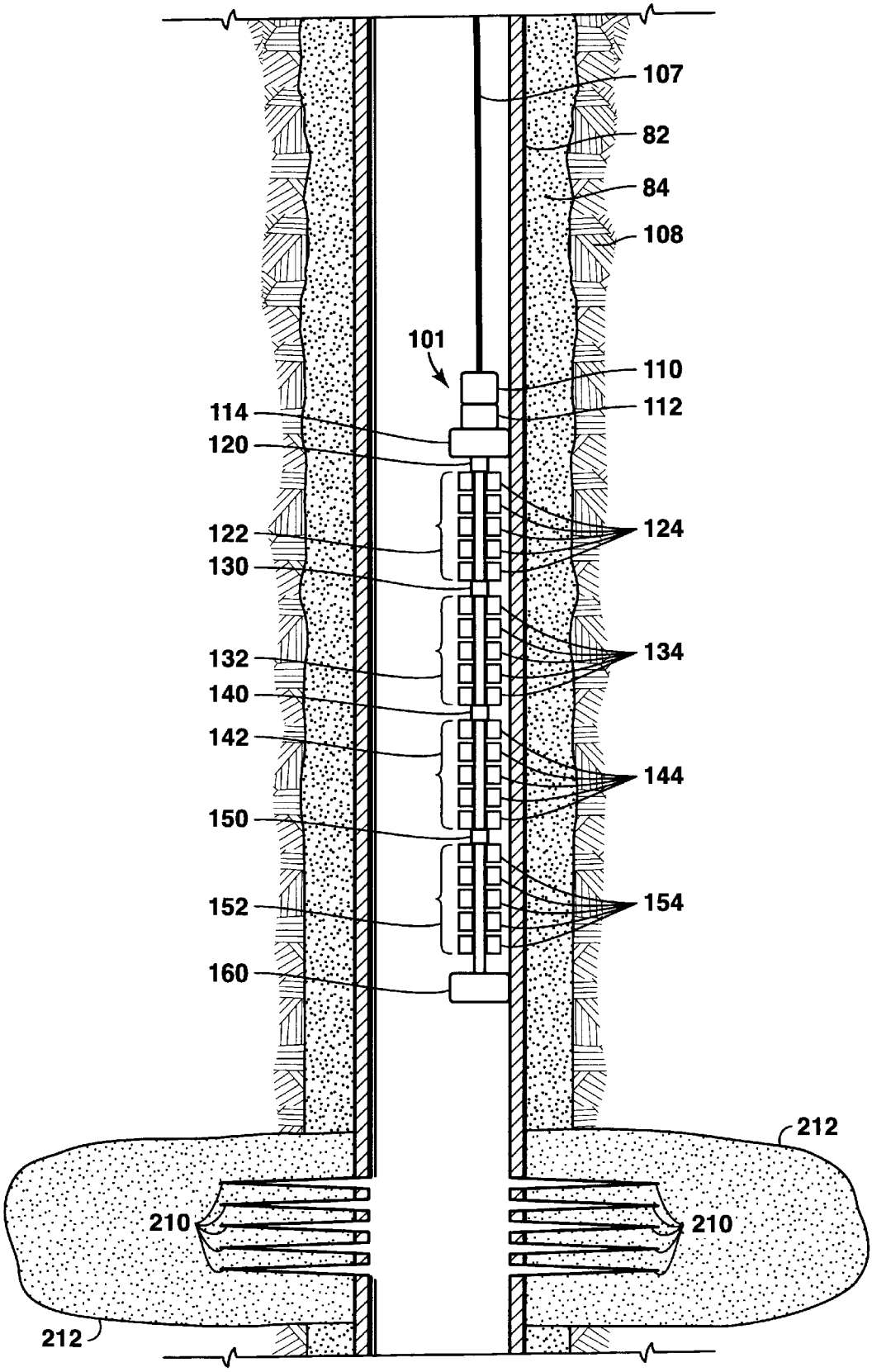
FIG. 5 represents the wellbore of FIG. 4 after the perforating device has been moved upward and away from the first perforated zone and with the first target zone being hydraulically fractured by pumping a slurry of proppant and fluid into the formation via the first set of perforation holes.

As shown in FIG. 5, after perforating the first zone, the first stage of the treatment would be pumped and positively forced to enter the first zone via the first set of ten perforation holes 210 and result in the creation of a hydraulic proppant fracture 212. Near the end of the first treatment stage, a quantity of ball sealers or other diversion agent sufficient to seal the first set of perforations would be injected into the first treatment stage.

Figure 6:
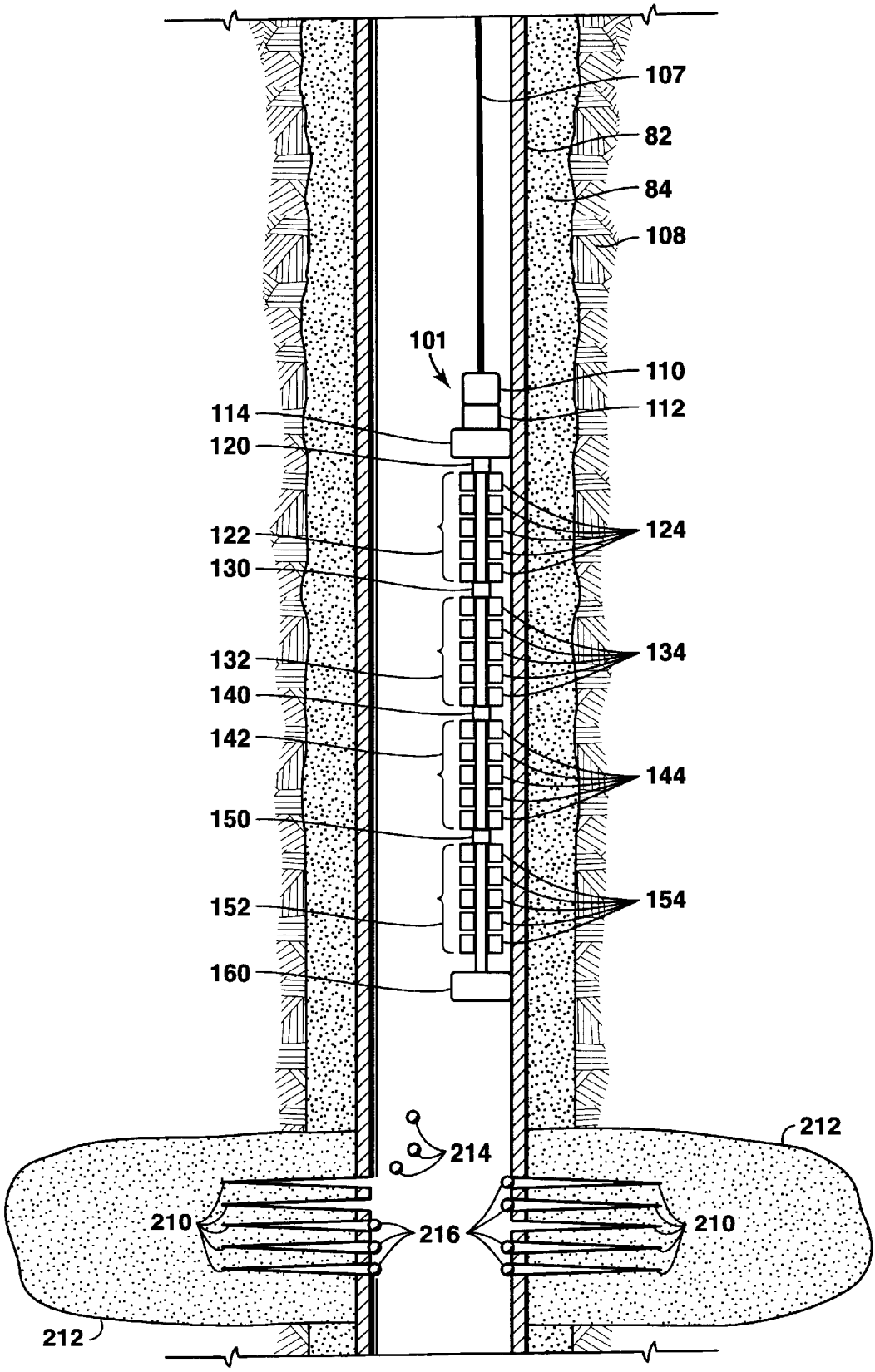
FIG. 6 represents the perforating device and wellbore of FIG. 5 after ball sealers have been injected into the wellbore and begin to seat on and seal the first set of perforation holes.

Following the injection of the diversion material, pumping would preferably continue at a constant rate with the second treatment stage without stopping between stages. Assuming the use of ball sealers, pumping would be continued as the first set of ball sealers reached and began sealing the first perforation set as illustrated in FIG. 6. As shown in FIG. 6, ball sealers 216 have begun to seat and seal perforation holes 210; while ball sealers 214 continue to be convected downward with the fluid flow towards perforation holes 210.

Figure 7:
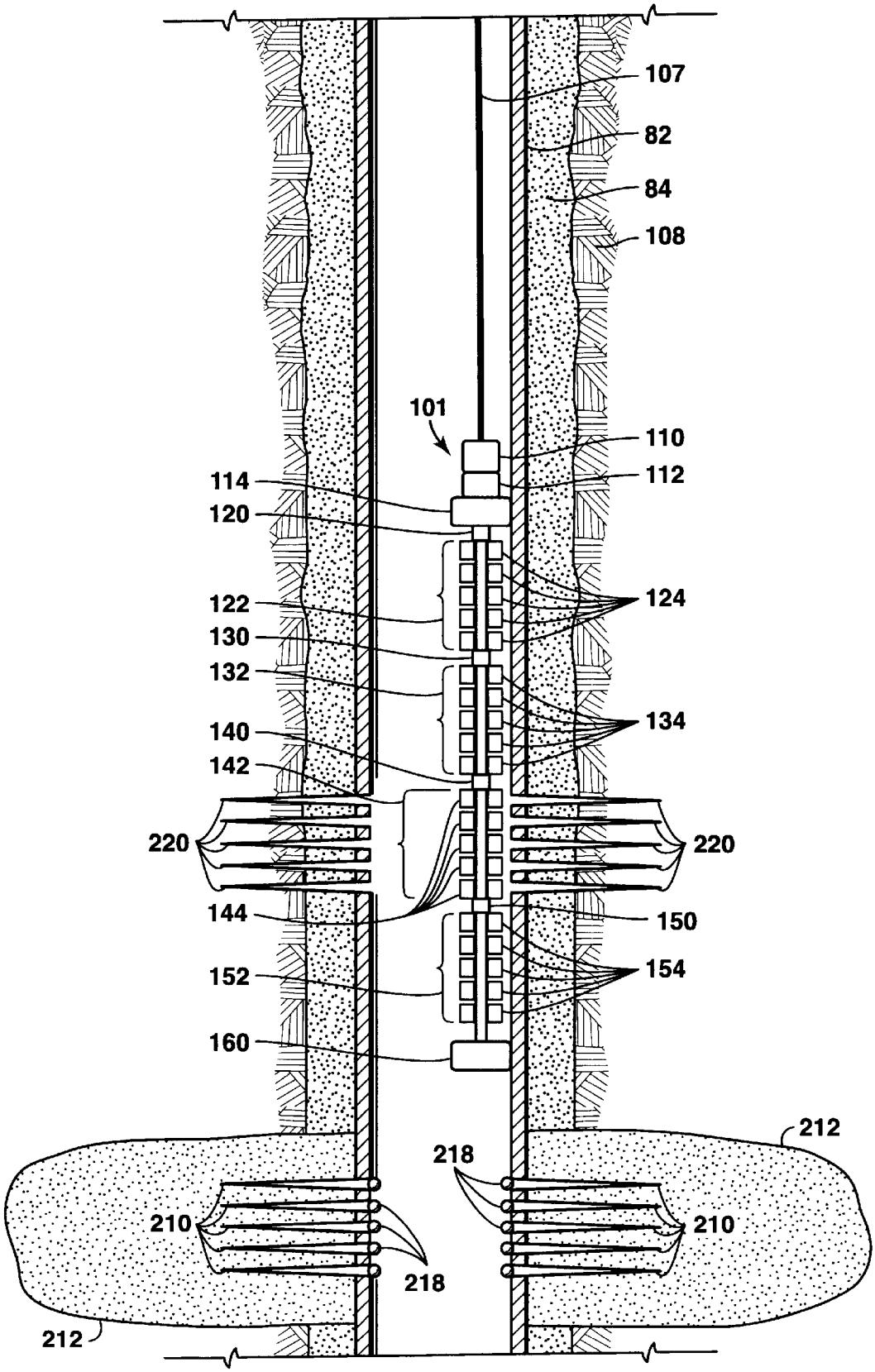
FIG. 7 represents the wellbore of FIG. 6 after the ball sealers have sealed the first set of perforation holes where the perforating device has been positioned at the depth location of the second interval and the second interval perforated by the second set of selectively-fired perforating charges on the perforating device.

As illustrated in FIG. 7, with the first set of perforations holes 210 sealed by ball sealers 218, the perforating device 101, if not already positioned appropriately, would be repositioned so that the ten perforation charges 144 would be opposite of the second zone to be treated. The ten perforation charges 144 would then be fired as shown in FIG. 7 to create a second set of ten perforation holes 220 that penetrate the wellbore to establish a flow path with the second zone to be treated.

It will be understood that any given set of perforations can, if desired, be a set of one, although generally multiple perforations would provide improved treatment results. In general, the desired number, size, and orientation of perforation holes used to penetrate the casing for each zone would be selected in part based on stimulation job design requirements, diversion agents, and formation and reservoir properties. It will also be understood that more than one segment of the gun assembly may be fired if desired to achieve the target number of perforations whether to remedy an actual or perceived misfire or simply to increase the number of perforations. It will also be understood that an interval is not necessarily limited to a single reservoir sand. Multiple sand intervals could be treated as a single stage using for example some element of the limited entry diversion method within a given stage of treatment. Although it is preferable to delay the firing of each set of perforation charges until some or all of the diversion agent(s) have passed by and are downstream of the perforating device, it will also be understood that any set of perforation charges may be fired at any time during the stimulation treatment.

It will also be understood that the triggering mechanism used to selectively-fire the charge can be actuated by either human action, or by automatic methods. For example, human action may involve a person manually-activating a switch to close the firing circuit and trigger the firing of the charges; while an automated means could involve a computer-controlled system that automatically fires the charges when a certain event occurs, such as an abrupt change in wellbore pressure or detection that ball sealers or the last sub-stage of proppant have passed by the gun. The triggering mechanism and equipment necessary for automatic charge firing could physically be located on the surface, within the wellbore, or contained as a component on the perforating device.

Figure 8:
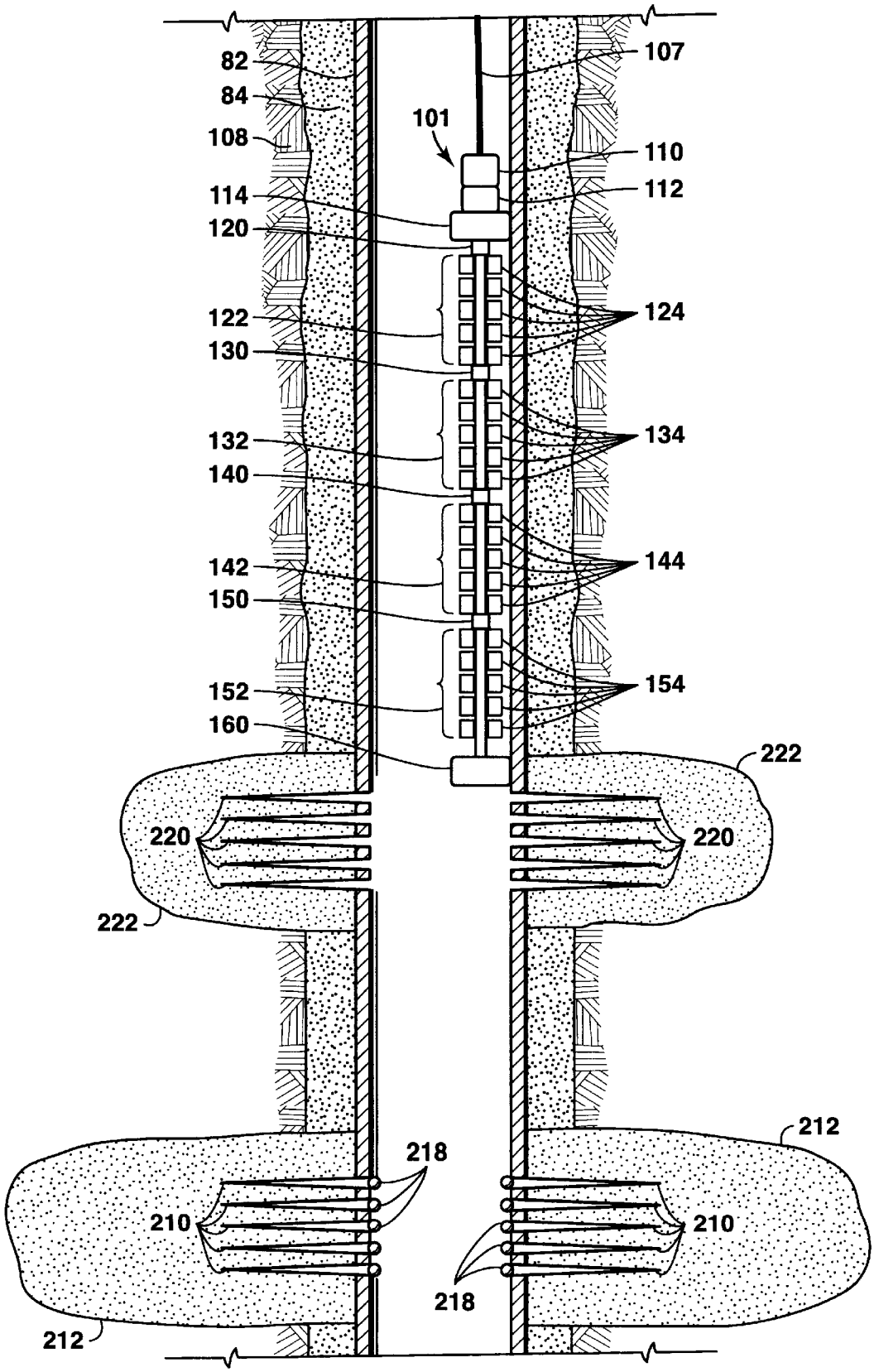
FIG. 8 represents the wellbore of FIG. 7 after the perforating device has been moved upward and away from the second perforated zone and with the second target zone being hydraulically fractured by pumping a slurry of proppant and fluid into the formation via the second set of perforation holes.

FIG. 8 shows the perforating device 101 as it would then be preferably positioned, with ten perforation charges 134 adjacent to the third zone to be treated, thereby minimizing the number of moves and theoretically reducing the likelihood of move-related complications. This positioning would also decrease the likelihood of required pumping rate changes to control pressure while moving the gun, thereby further reducing the risk of complications. The pumping of the second stage would be continued such that the second treatment stage is positively forced to enter the second zone via the second set of perforation holes 220 and result in the creation of a hydraulic proppant fracture 222. Near the end of the second treatment stage, a quantity of ball sealers sufficient to seal the second set of perforation holes 220 would be injected into the second treatment stage. Following the injection of the ball sealers and the injection of the second treatment stage into the wellbore, pumping continues with the third treatment stage. Pumping would be continued until the second deployment of ball sealers seated on the second perforation set. The process as defined above would then be repeated for the desired number of intervals to be treated. For the specific perforating device 101 discussed for descriptive purposes in FIG. 3 through FIG. 8, up to a total of four formation intervals may be treated in this specific example since the perforating device 101 contains four select-fire perforation charge carriers 152, 142, 132, and 122 with each set of perforation charges 154, 144, 134, and 124 capable of being individually-controlled and selectively-fired during the treatment. In the most general sense, the method is applicable for treatment of two or more intervals with a single wellbore entry of the perforating device 101.

In general, intervals may be grouped for treatment based on reservoir properties, treatment design considerations, or equipment limitations. After each group of intervals (preferably two or more), at the end of a workday (often defined by lighting conditions), or if difficulties with sealing one or more zones are encountered, a bridge plug or other mechanical device would preferably be used to isolate the group of intervals already treated from the next group to be treated. One or more select-fire set bridge plugs or fracture baffles could also be deployed on the perforating gun assembly and set as desired during the course of the stimulation operation using a selectively-fired setting tool to provide positive mechanical isolation between perforated intervals and eliminate the need for a separate wireline ran to set mechanical isolation devices or diversion agents between groups of fracture stages.

Although the perforating device described in this embodiment used remotely fired charges to perforate the casing and cement sheath, alternative perforating devices including but not limited to water and/or abrasive jet perforating, chemical dissolution, or laser perforating could be used within the scope of this invention for the purpose of creating a flow path between the wellbore and the surrounding formation. For the purposes of this invention, the term "perforating device" will be used broadly to include all of the above, as well as any actuating device suspended in the wellbore for the purpose of actuating charges, or other devices that may be conveyed by the casing or other means external to the actuating device to establish hydraulic communication between the wellbore and formation.

The perforating device may be a perforating gun assembly comprised of commercially available gun systems. These gun systems could include a "select-fire system" such that a single gun would be comprised of multiple sets of perforation charges. Each individual set of one or more perforation charges can be remotely controlled and fired from the surface using electric, radio, pressure, fiber-optic or other actuation signals. Each set of perforation charges can be designed (number of charges, number of shots per foot, hole size, penetration characteristics) for optimal perforation of the individual zone that is to be treated with an individual stage. Gun tubes ranging in size from approximately 1 11/16 inch outer diameter to 2 5/8 inch outer diameter hollow-steel charge carriers are commercially available and can be readily manufactured with sufficiently powerful perforating charges to adequately penetrate 4½ inch diameter or greater casing. For application in this inventive method, smaller gun diameters would generally be preferable so long as the resulting perforations can provide sufficient hydraulic communication with the formation to allow for adequate stimulation of the reservoir formation. In general, the inventive method can be readily employed in production casings of 4½ inch diameter or greater with existing commercially available perforating gun systems and ball sealers. Using other diversion agents or smaller ball sealers, the inventive method could be employed in smaller casings.

Each individual gun may be on the order of 2 to 8 feet in length, and contain on the order of 8 to 20 perforating charges placed along the gun tube at shot density ranging between 1 and 6 shots per foot, but preferably 2 to 4 shots per foot. In a preferred embodiment, as many as 15 to 20 individual guns could be stacked one on top of another such that the assembled gun system total length is preferably kept to less than approximately 80 to 100 feet. This total gun length can be deployed in the wellbore using readily-available surface crane and lubricator systems. Longer gun lengths could also be used, but would generally require additional or special equipment.

The perforating device can be conveyed downhole by various means, and could include electric line, wireline, slickline, conventional tubing, coiled tubing, and casing conveyed systems. The perforating device can remain in the hole after perforating the first zone and then be positioned to the next zone before, during, or after treatment of the first zone. The perforating device would preferably be moved above the level of the open perforations or into the lubricator at some time before ball sealers are released into the wellbore, but may also be in any other position within the wellbore if there is sufficient clearance for ball sealers or other diverter material to pass or for the gun to pass seated ball sealers if necessary. Alternatively, especially if treatment is performed from the highest to the lowest set of perforations, the spent perforating device could be released from the conveying mechanism and dropped in the hole.

Alternatively, depending on the treatment design and the number of zones, the perforating device can be pulled removed from the wellbore during a given stage of the treatment for replacement and then inserted back in the wellbore. The time duration and hence the cost of the completion operation can be minimized by use of shallow offset wells that are drilled within the reach of the crane holding the lubricator system in place. The shallow offset wells would possess surface slips such that spare gun assemblies could be held and stored safely in place below ground level and can be rapidly picked up to minimize time requirements for gun replacement. The perforating device can be pre-sized and designed to provide for multiple sets of perforations. A bridge plug or other mechanical diversion device with a select-fire or other actuation method could be contained as part of the perforating device to be set before or after, but preferably before, perforating.

When using ball sealers as the diversion agent and a select-fire perforating gun system as the perforating device, the select-fire perforating gun system would preferably contain a device to positively position (e.g. centralize or decentralize) the gun relative to the production casing to accommodate shooting of perforations that have a relatively circular shape with preferably a relatively smooth edge to better facilitate ball-sealer sealing of the perforations. One such perforating apparatus which could be used in the inventive method is disclosed in co-pending U.S. Provisional Application filed Jun. 19, 2001, entitled "Perforating Gun Assembly for Use in Multi-Stage Stimulation Operations" (PM# 2000.04, R. C. Tolman et. al.) In some applications it may be desirable to use mechanical or magnetic positioning devices, with perforation charges oriented at approximately 0 degrees and 180 degrees relative to the circumferential position of the positioning device (as illustrated in FIG. 3) to provide the relatively circular perforation holes.

A select-fire gun system or other perforating device would preferably contain a depth control device such as a casing collar locator (CCL) to be used to locate the perforating guns at the appropriate downhole depth position. For example, if the perforating device is suspended in the wellbore using wireline, a conventional wireline CCL could be deployed on the perforating device; alternatively, if the perforating device is suspended in the wellbore using tubing, a conventional mechanical CCL could be deployed on the perforating device. In addition to the CCL, the perforating device may also be configured to contain other instrumentation for measurement of reservoir, fluid, and wellbore properties as deemed desirable for a given application. For example, temperature and pressure gauges could be deployed to measure downhole fluid temperature and pressure conditions during the course of the treatment; a nuclear fluid density logging device could be used to measure effective downhole fluid density (which would be particularly useful for determining the downhole distribution and location of proppant during the course of a hydraulic proppant fracture treatment); a radioactive detector system (e.g., gamma-ray or neutron measurement systems) could be used for locating hydrocarbon bearing zones or identifying or locating radioactive material within the wellbore or formation. The perforating device may also be configured to contain devices or components to actuate mechanical diversion agents deployed as part of the production casing.

Assuming a select-fire gun assembly is used, the wireline would preferably be 5/16-inch diameter or larger armor-clad monocable. This wireline may typically possess approximately 5,500-lbs suggested working tension or greater therefore providing substantial pulling force to allow gun movement over a wide range of stimulation treatment flow conditions. Larger diameter cable could be used to provide increased limits for working tension as deemed necessary based on field experience.

An alternative embodiment would be the use of production casing conveyed perforating charges such that the perforating charges were built into or attached to the production casing in such a manner as to allow for selective firing. For example, selective firing could be accomplished via hydraulic actuation from surface. Positioning the charges in the casing and actuating the charges from the surface via hydraulic actuation may reduce potential concerns with respect to ball sealer clearance, damage of the gun by fracturing fluids, or bridging of fracture proppant in the wellbore due to obstruction of the flow path by the perforating gun.

As an example of the fracture treatment design for stimulation of a 15-acre size sand lens containing hydrocarbon gas, the first fracture stage could be comprised of "sub-stages" as follows: (a) 5,000 gallons of 2% KCl water; (b) 2,000 gallons of cross-linked gel containing 1 pound-per-gallon of proppant; (c) 3,000 gallons of cross-linked gel containing 2 pounds-per-gallon of proppant; (d) 5,000 gallons of cross-linked gel containing 3 pounds-per-gallon of proppant; and (e) 3,000 gallons of cross-linked gel containing 4 pound-per-gallon of proppant such that 35,000 pounds of proppant are placed into the first zone.

At or near the completion of the last sand sub-stage of the first fracture stage, a sufficient quantity of ball sealers to seal the number of perforations accepting fluid are injected into the wellbore while pumping is continued for the second fracture stage (where each fracture stage consists of one or more sub-stages of fluid). Typically the ball sealers would be injected into the trailing end of the proppant as the 2% KCl water associated with the first sub-stage of the second treatment stage would facilitate a turbulent flush and wash of the casing. The timing of the ball injection relative to the end of the proppant stage may be calculated based on well-known equations describing ball/proppant transport characteristics under the anticipated flow conditions. Alternatively, timing may be determined through field testing with a particular fluid system and flow geometry. To better facilitate ball sealer seating and sealing under the widest possible range of pumping conditions, buoyant ball sealers (i.e., those ball sealers that have density less than the minimum density of the fluid system) are preferably used.

As indicated above, at the end of the last sand sub-stage, it may be preferable to implement a casing flushing procedure whereby multiple proppant/fluid blenders and a vacuum truck are used to provide a sharp transition from proppant-laden cross-linked fluid to non-proppant laden 2% KCl water. During the operation the proppant-laden fluid is contained in one blender, while the 2% KCl water is contained in another blender. Appropriate fluid flow control valves are actuated to provide for pumping the 2% KCl water downhole and shutting off the proppant-laden fluid from being pumped downhole. The vacuum truck is then used to empty the proppant-laden fluid from the first blender. The procedure is then repeated at the end of each fracture stage. The lower viscosity 2% KCl water acts to provide more turbulent flow downhole and a more distinct interface between the last sub-stage of proppant-laden cross-linked fluid and the first sub-stage of 2% KCl water of the next fracture stage. This method helps to minimize the potential for perforating in proppant-laden fluid, thereby reducing the risk of plugging the perforations with proppant from the fluid, and helps to minimize potential ball sealer migration as the balls travel downhole (i.e., further spreading of the ball sealers such that the distance between the first and last ball sealer increases as the balls travel downhole).

Once a pressure rise associated with ball sealer seating and sealing on the first set of perforations is achieved, the second select fire gun is shot and the gun moved, preferably to the next zone. Depending on the perforating gun characteristics, some gun movement may be preferred to reduce the risk of differential sticking and obstruction of the flow path while trying to stimulate or seal the perforations. The pressure/rate response is monitored to evaluate if a fracture is initiated or if a screen-out may be imminent. If a fracture appears to be initiated, the gun is then moved to the next zone. If a screen-out condition is present, operations are suspended for a finite period of time to let proppant settle-out and then another set of charges is shot at the same zone. This data can then be used to establish if a "wait-time" is required between ball sealer seating and the perforating operation in subsequent fracture stages.

During transition of pumping between stages, and during pumping of any treatment stage, pressure ideally should be maintained at all times at or above the highest of the previous zones' final fracture pressures in order to keep the ball sealers seated on previous zones' perforations during all subsequent operations. The pressure may be controlled by a variety of means including selection of appropriate treatment fluid densities (effective density), appropriate increases or decreases in pump rate, in the number of perforations shot in each subsequent zone, or in the diameter of subsequent perforations. Also, surface back-pressure control valves or manually operated chokes could be used to maintain a desired rate and pressure during ball seating and sealing events. Should pressure not be maintained it is possible for some ball sealers to come off seat and then the job may progress in a sub-optimal technical fashion, although the well may still be completed in an economically viable fashion.

Alternatively a sliding sleeve device, flapper valve device, or similar mechanical device conveyed by the production casing could be used as the diversion agent to temporarily divert flow from the treated set of perforations. The sliding sleeve, flapper valve, or similar mechanical device could be actuated by a mechanical, electrical, hydraulic, optical, radio or other actuation device located on the perforating device or even by remote signal from the surface. As an example of the use of a mechanical device as a diversion agent, FIG. 9 through FIG. 14 illustrate another alternative embodiment of the inventive method where a mechanical flapper valve is used as a mechanical diversion agent.

Figure 9:
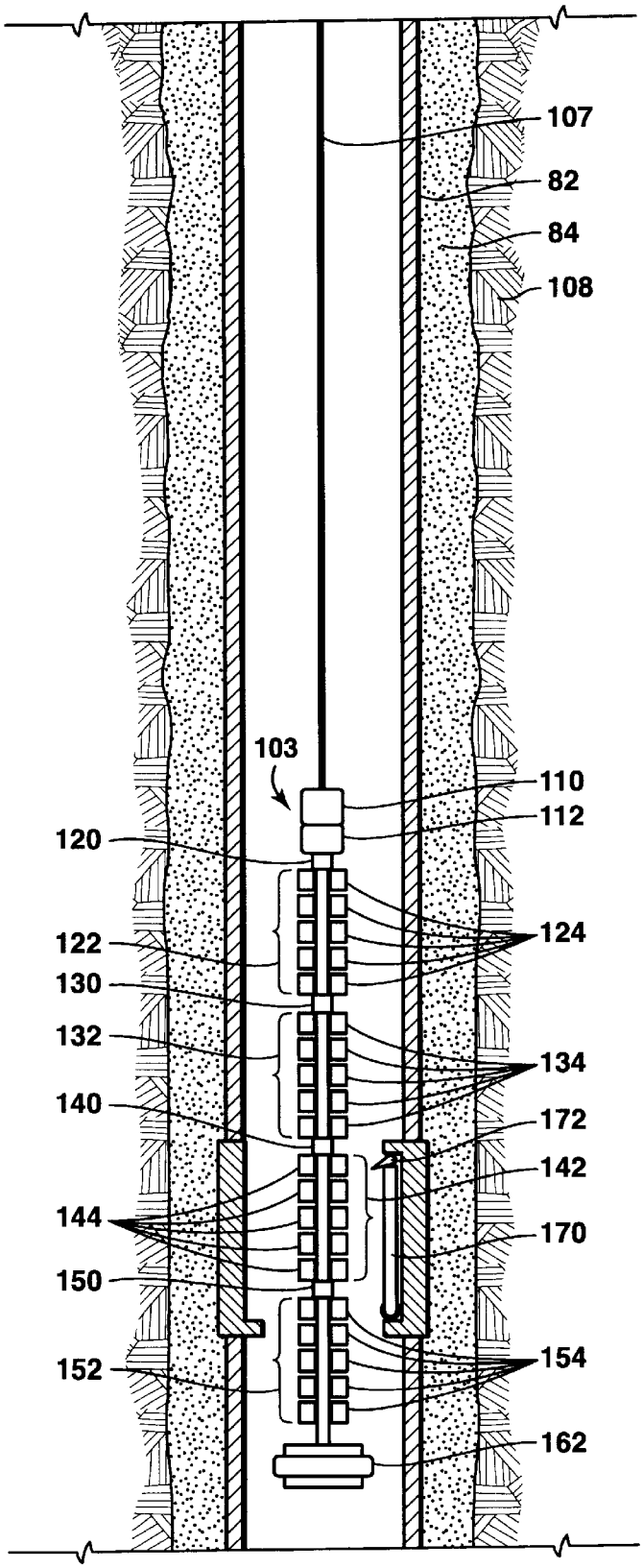
FIG. 9 represents a selectively-fired perforating device suspended by wireline in an unperforated wellbore containing a mechanical zonal isolation device ("flapper valve") with the perforating device positioned at the depth location to be perforated by the first set of selectively-fired perforating charges. The perforating device in this illustration also contains a key device to provide a means to actuate the mechanical zonal isolation device.

FIG. 9 shows a perforating device 103 suspended by wireline 107 in production casing 82 containing a mechanical flapper valve 170. In FIG. 9, the mechanical flapper valve 170 is held in the open position by the valve lock mechanism 172 and production casing 82 has not yet been perforated. The perforating device 103 in FIG. 9 contains a rope-socket/shear-release/fishing-neck sub 110; casing collar-locator 112; four select-fire perforation charge carriers 152, 142, 132, 122; and valve key device 162 that can serve to unlock the valve lock mechanism 172 and result in closure of the mechanical flapper valve 170. Select-fire perforation charge carrier 152 contains ten perforation charges 154 and is independently fired using the select-fire firing head 150; select-fire perforation charge carrier 142 contains ten perforation charges 144 and is independently fired using the select-fire firing head 140; select-fire perforation charge carrier 132 contains ten perforation charges 134 and is independently fired using the select-fire firing head 130; select-fire perforation charge carrier 122 contains ten perforation charges 124 and is independently fired using the select-fire firing head 120.

Figure 10:
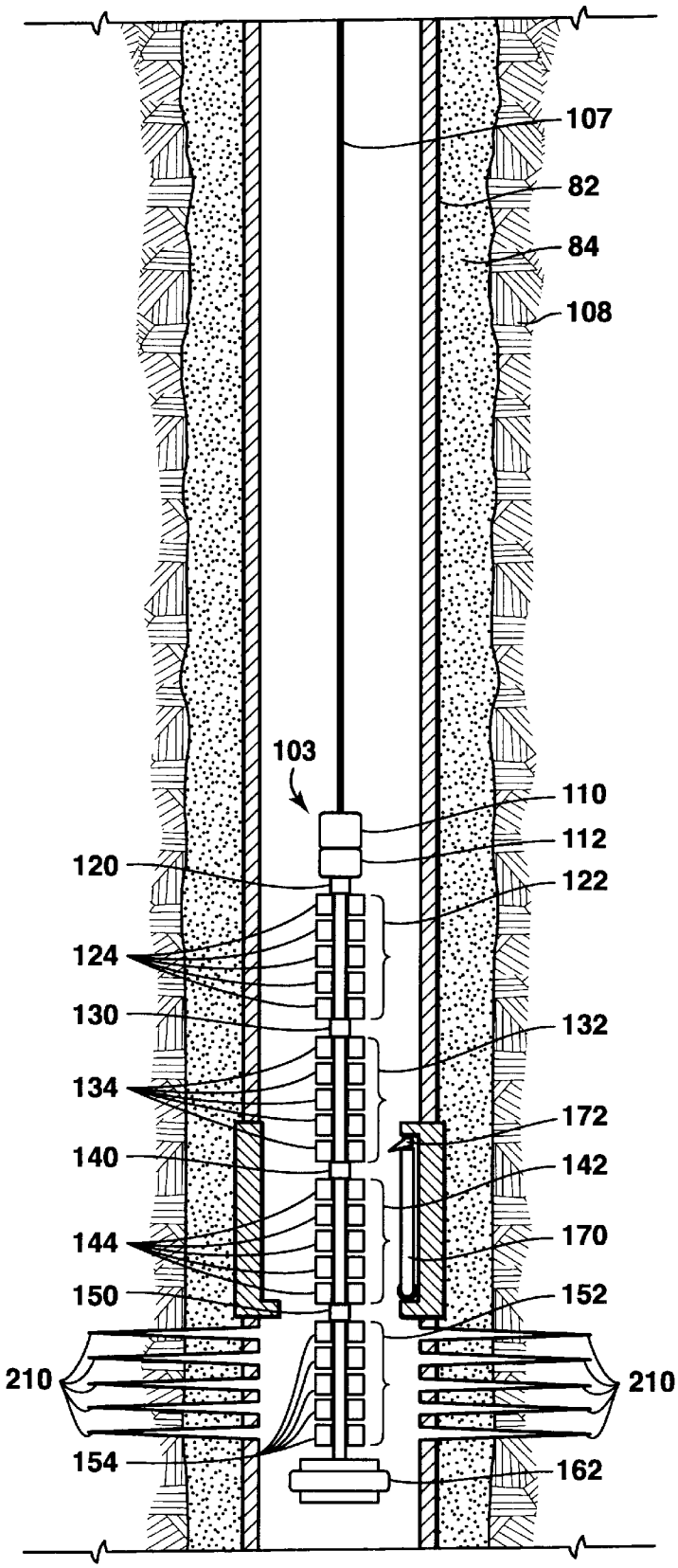
FIG. 10 represents the perforating device and wellbore of FIG. 9 after the first set of selectively-fired perforating charges are fired resulting in perforation holes through the casing and cement sheath and into the formation such that hydraulic communication is established between the wellbore and formation.
Figure 11:
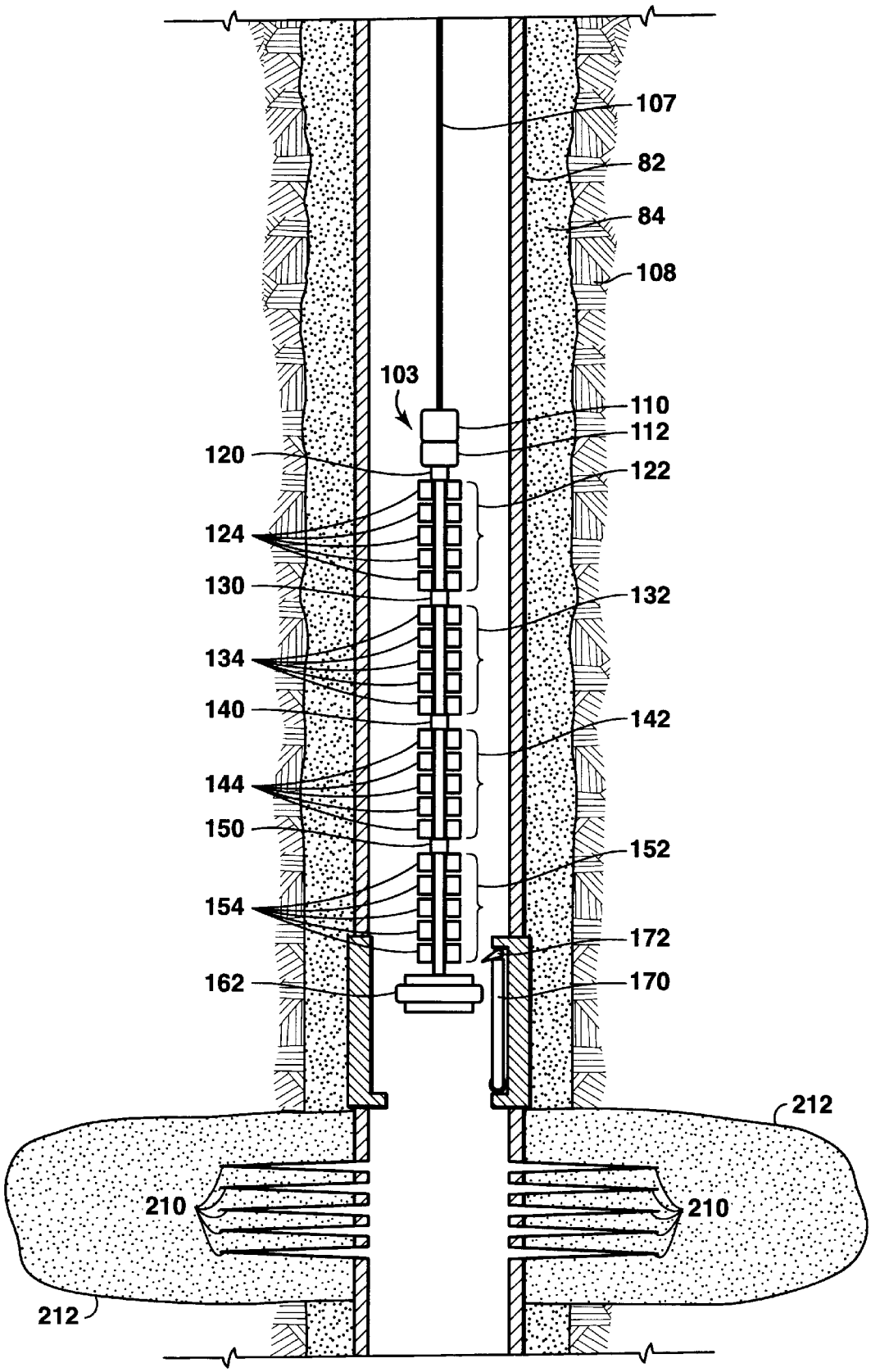
FIG. 11 represents the wellbore of FIG. 10 after the perforating device has been moved above the first perforated zone and with the first target zone being hydraulically fractured by pumping a slurry of proppant and fluid into the formation via the first set of perforation holes.

In FIG. 9 the perforating device 103 is positioned in the wellbore with perforation charges 154 at the location of the first zone to be perforated. FIG. 10 then shows the wellbore of FIG. 9 after the first set of selectively-fired perforating charges 154 are fired and create perforation holes 210 that penetrate through the production casing 82 and cement sheath 84 and into the formation such that hydraulic communication is established between the wellbore and formation. FIG. 11 represents the wellbore of FIG. 10 after the perforating device 103 has been moved upward and away from the first perforated zone and the first target zone is illustrated as having been stimulated with a hydraulic proppant fracture 212 by pumping a slurry of proppant material and carrier fluid into the formation via the first set of perforation holes 210.

Figure 12:
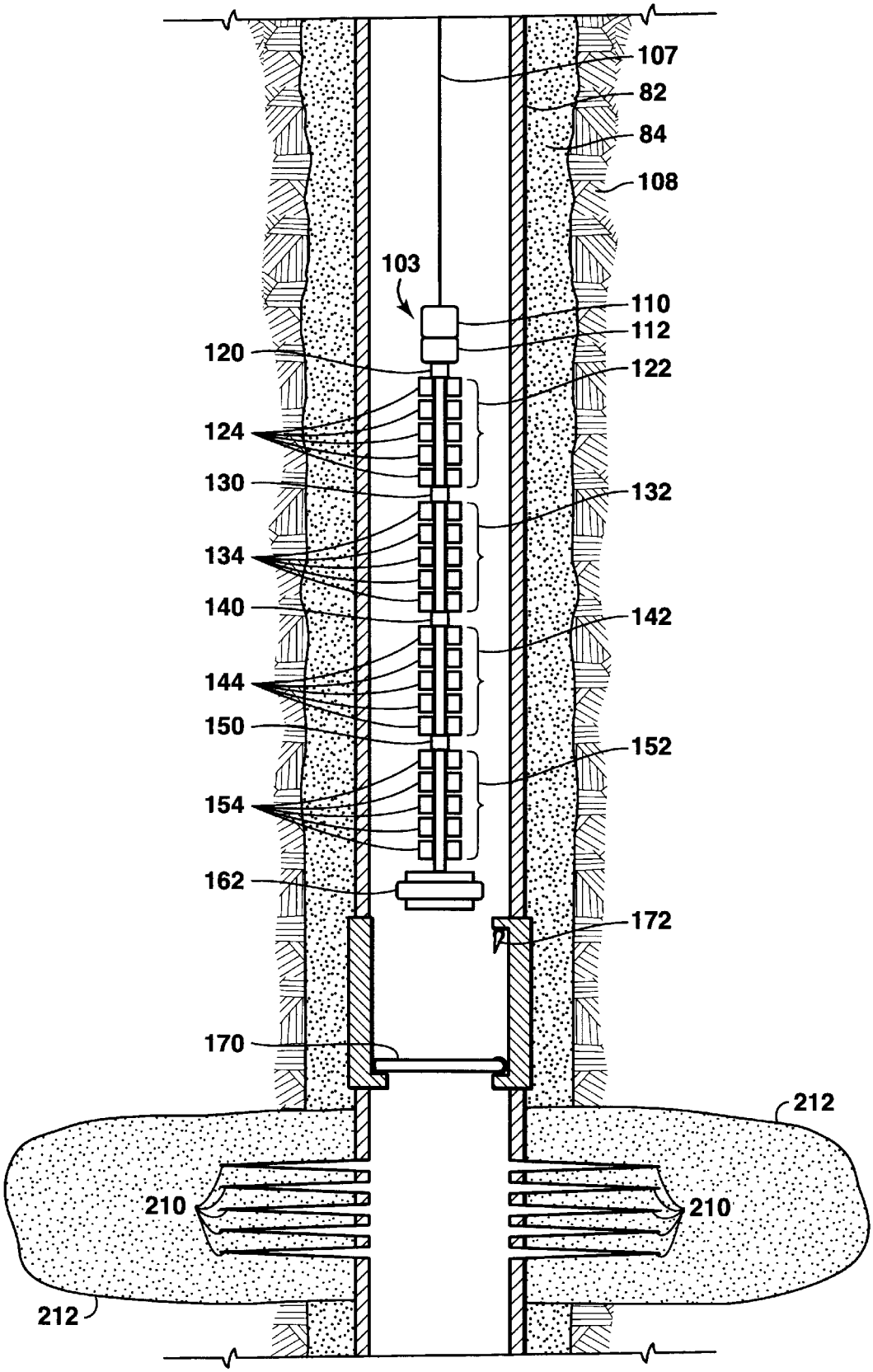
FIG. 12 represents the perforating device and wellbore of FIG. 11 after the perforating device actuates the mechanical isolation device and after the mechanical isolation device seals the first set of perforation holes from the wellbore above the isolation device.

As shown in FIG. 12, the valve key device 162 has been used to mechanically engage and release the valve lock mechanism 172 such that the mechanical flapper valve 170 is released and closed to positively isolate the portion of the wellbore below mechanical flapper valve 170 from the portion of the wellbore above the mechanical flapper valve 170, and thereby effectively hydraulically seal the first set of perforation holes 210 from the wellbore above the mechanical flapper valve 170.

Figure 13:
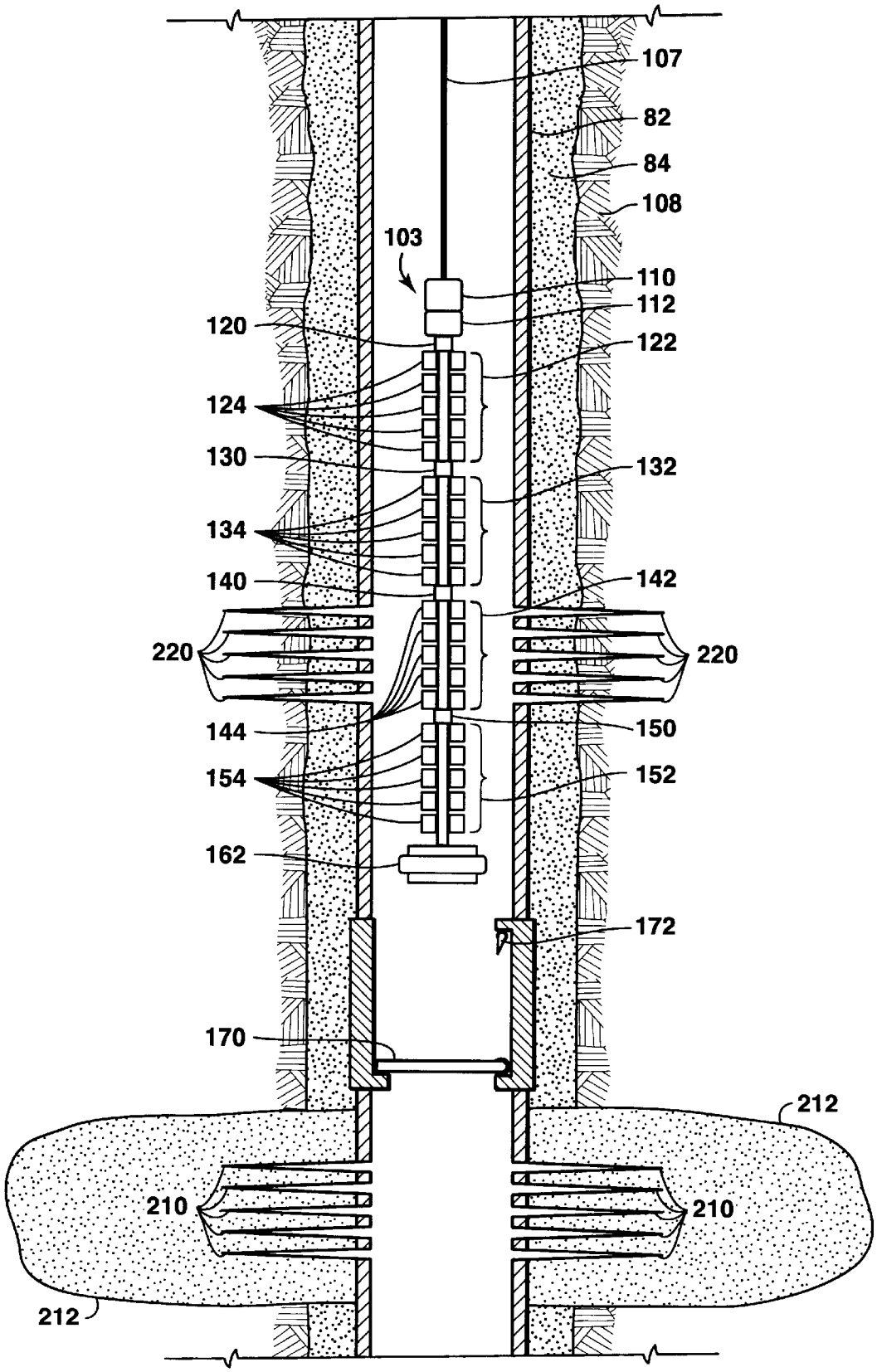
FIG. 13 represents the wellbore of FIG. 12 where the perforating device has been positioned at the depth location of the second interval and the second interval perforated by the second set of selectively-fired perforating charges on the perforating device.
Figure 14:
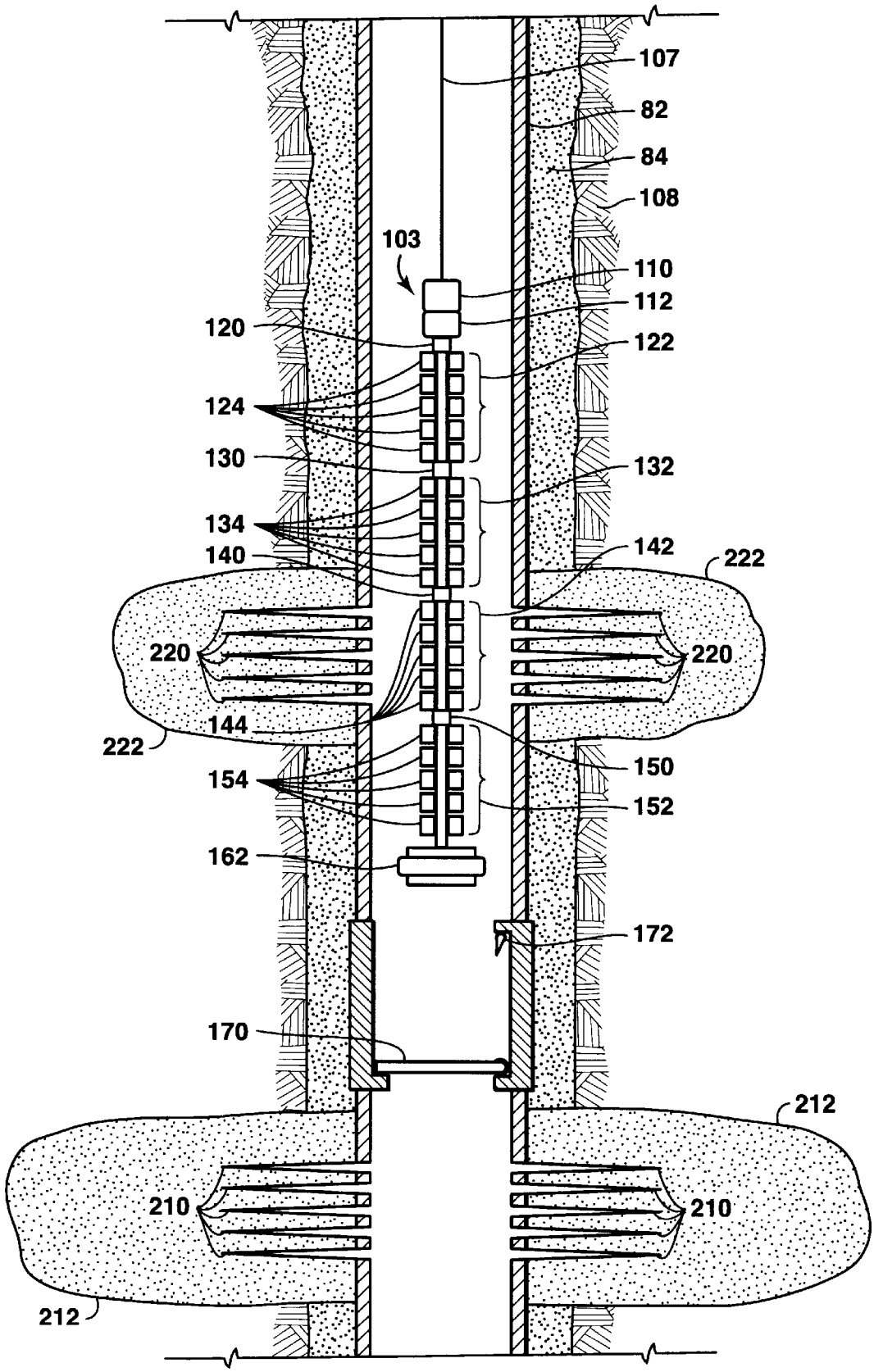
FIG. 14 represents the wellbore of FIG. 13 after the perforating device has been moved further uphole from the second perforated zone and with the second target zone being hydraulically fractured by pumping a slurry of proppant and fluid into the formation via the second set of perforation holes.

FIG. 13 then illustrates the wellbore of FIG. 12 with the perforating device 103 now positioned so that the second set of perforation charges 142 are located at the depth corresponding to the second interval and used to create the second set of perforation holes 220. FIG. 14 then shows the second target zone being stimulated with hydraulic proppant fracture 222 by pumping a slurry of proppant and fluid into the formation via the second set of perforation holes 220.

Figure 15:
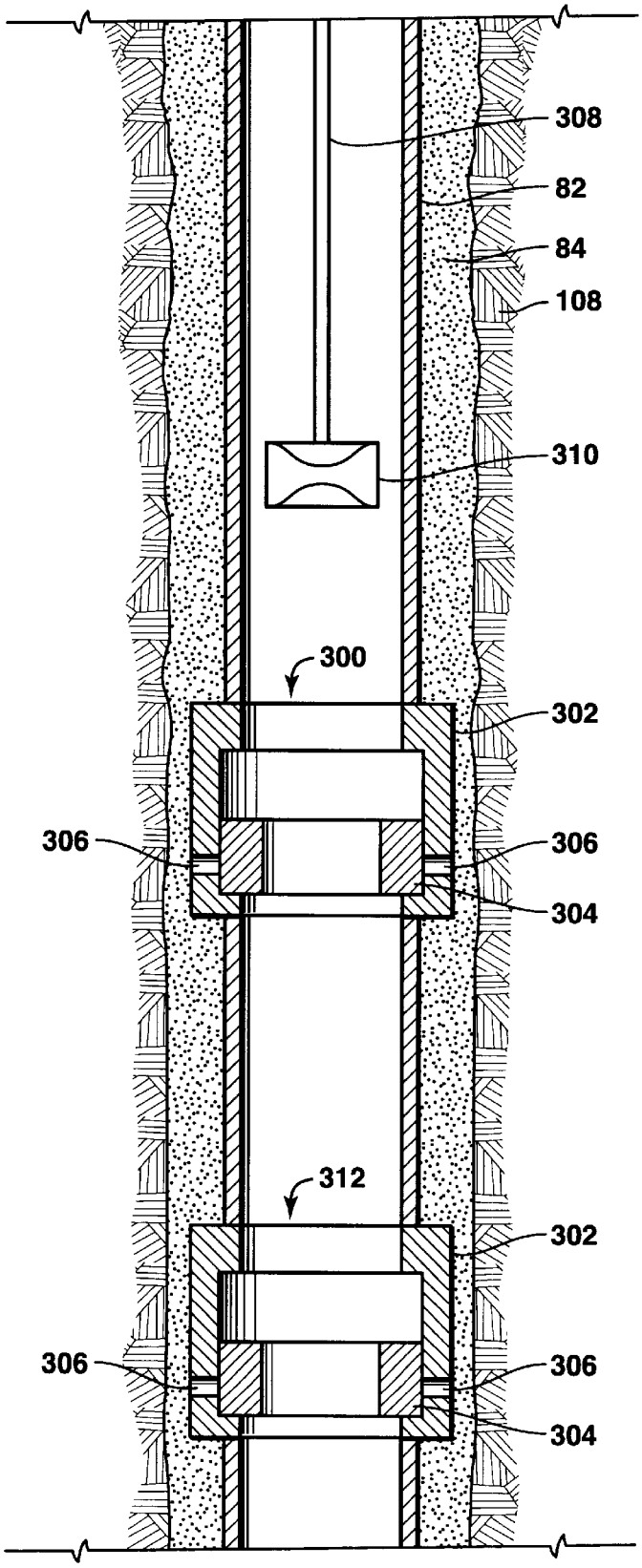
FIG. 15 represents a sliding sleeve shifting tool suspended by jointed tubing in a wellbore containing sliding sleeve devices as mechanical zonal isolation devices. The sliding sleeve devices contain holes that were pre-drilled at the surface prior to deploying the sliding sleeves in the wellbore. The sliding sleeve shifting tool is used to open and close the sliding sleeves as desired to provide hydraulic communication and stimulation of the desired zones without removal of the sliding sleeve shifting tool from the wellbore.

An alternative embodiment of the invention using pre-perforated sliding sleeves as the mechanical isolation devices is shown in FIG. 15. For illustrative purposes, two pre-perforated sliding sleeve devices are shown deployed in FIG. 15. Sliding sleeve device 300 and sliding sleeve device 312 are installed with the production casing 82 prior to stimulation operations. The sliding sleeve device 300 and sliding sleeve device 312 each contain an internal sliding sleeve 304 housed within the external sliding sleeve body 302. The internal sliding sleeve 304 can be moved to expose perforation holes 306 to the interior of the wellbore such that hydraulic communication is established between the wellbore and the cement sheath 84 and formation 108. The perforation holes 306 are placed in the sliding sleeves prior to deployment of the sliding sleeves in the wellbore. Also shown in FIG. 15 is the sliding sleeve shifting tool 310 that is deployed on jointed tubing 308. It is noted that alternatively, the sliding shifting tool could be also deployed on coiled tubing or wireline. The sliding sleeve shifting tool 310 is designed and manufactured such that it can be engaged with and disengaged from the internal sliding sleeve 304. When the sliding sleeve shifting tool 310 is engaged with the internal sliding sleeve 304, a slight upward movement of jointed tubing 308 will allow the internal sliding sleeve 304 to move upward and expose perforation holes 306 to the wellbore.

The inventive method for this sliding sleeve embodiment shown in FIG. 15 would involve: (a) deploying the sliding sleeve shifting tool 310 to shift the internal sliding sleeve 304 contained in sliding sleeve device 312 to expose perforation holes 306 to the interior of the wellbore such that hydraulic communication is established between the wellbore and the cement sheath 84 and formation 108; (b) pumping the stimulation treatment into perforation holes 306 contained in sliding sleeve device 312 to fracture the formation interval "and any surrounding cement sheath". The complete element (b) will then read: "(b) pumping the stimulation treatment into perforation holes 306 contained in sliding sleeve device 312 to fracture the formation interval and any surrounding cement sheath"; (c) deploying the sliding sleeve shifting tool 310 to shift the internal sliding sleeve 304 contained in sliding sleeve device 312 to close perforation holes 306 to the interior of the wellbore such that hydraulic communication is eliminated between the wellbore and the cement sheath 84 and formation 108; (d) then repeating steps (a) through (c) for the desired number of intervals. After the desired number of intervals are stimulated, the sliding sleeves, for example, can be re-opened using a sliding sleeve shifting tool subsequently deployed on tubing to place the multiple intervals on production.

Alternatively, the sliding sleeve could possess a sliding sleeve perforating window that could be opened and closed using a sliding sleeve shifting tool contained on the perforation device. In this embodiment, the sliding sleeve would not contain pre-perforated holes, but rather, each individual sliding sleeve window would be sequentially perforated during the stimulation treatment with a perforating device. The inventive method in this embodiment would involve: (a) locating the perforating device so that the first set of select-fire perforation charges are placed at the location corresponding to the first sliding sleeve perforating window; (b) perforating the first sliding sleeve perforating window; (c) pumping the stimulation treatment into the first set of perforations contained within the first sliding sleeve perforating window; (d) using the sliding sleeve shifting tool deployed on the perforating device to move and close the interior sliding sleeve over the first set of perforations contained within the sliding sleeve perforating window, and (e) then repeating steps (a) through (d) for the desired number of intervals. After the desired number of intervals are stimulated, the sliding sleeves, for example, can be shifted using a sliding sleeve shifting tool subsequently deployed on tubing to place the multiple intervals on production.

Figure 16:
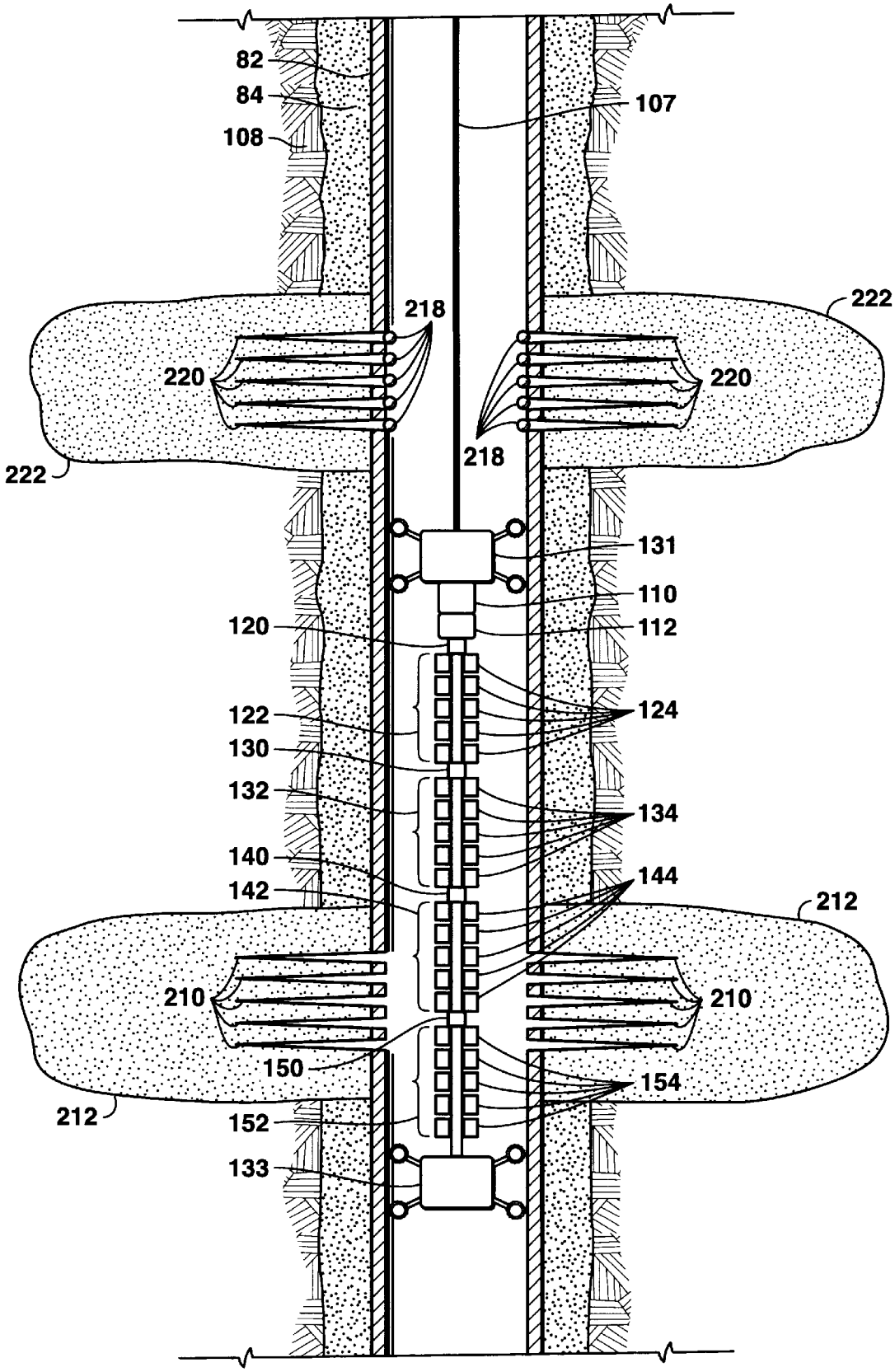
FIG. 16 represents the use of a tractor system deployed with the perforating device to control placement and positioning of the perforating device in the wellbore.

FIG. 16 illustrates an alternative embodiment of the invention where a tractor system, comprised of upper tractor drive unit 131 and lower tractor drive unit 133, is attached to the perforating device and is used to deploy and position the BHA within the wellbore. In this embodiment, treatment fluid is pumped down the annulus between the wireline 107 and production casing 82 and is positively forced to enter the targeted perforations. FIG. 16 shows that the ball sealers 218 have sealed the perforations 220 so that the next interval is stimulated with hydraulic fracture 212. The operations are then continued and repeated as appropriate for the desired number of formation zones and intervals.

The tractor system could be self-propelled, controlled by on-board computer systems, and carry on-board signaling systems such that it would not be necessary to attach cable or tubing for positioning, control, and/or actuation of the tractor system. Furthermore, the various components on the perforating device could also be controlled by on-board computer systems, and carry on-board signaling systems such that it is not necessary to attach cable or tubing for control and/or actuation of the components or communication with the components. For example, the tractor system and/or the other bottomhole assembly components could carry on-board power sources (e.g., batteries), computer systems, and data transmission/reception systems such that the tractor and perforating device components could either be remotely controlled from the surface by remote signaling means, or alternatively, the various on-board computer systems could be pre-programmed at the surface to execute the desired sequence of operations when deployed in the wellbore. Such a tractor system may be particularly beneficial for treatment of horizontal and deviated wellbores as depending on the size and weight of the perforating device additional forces and energy may be required for placement and positioning of the perforating device.

Figure 17:
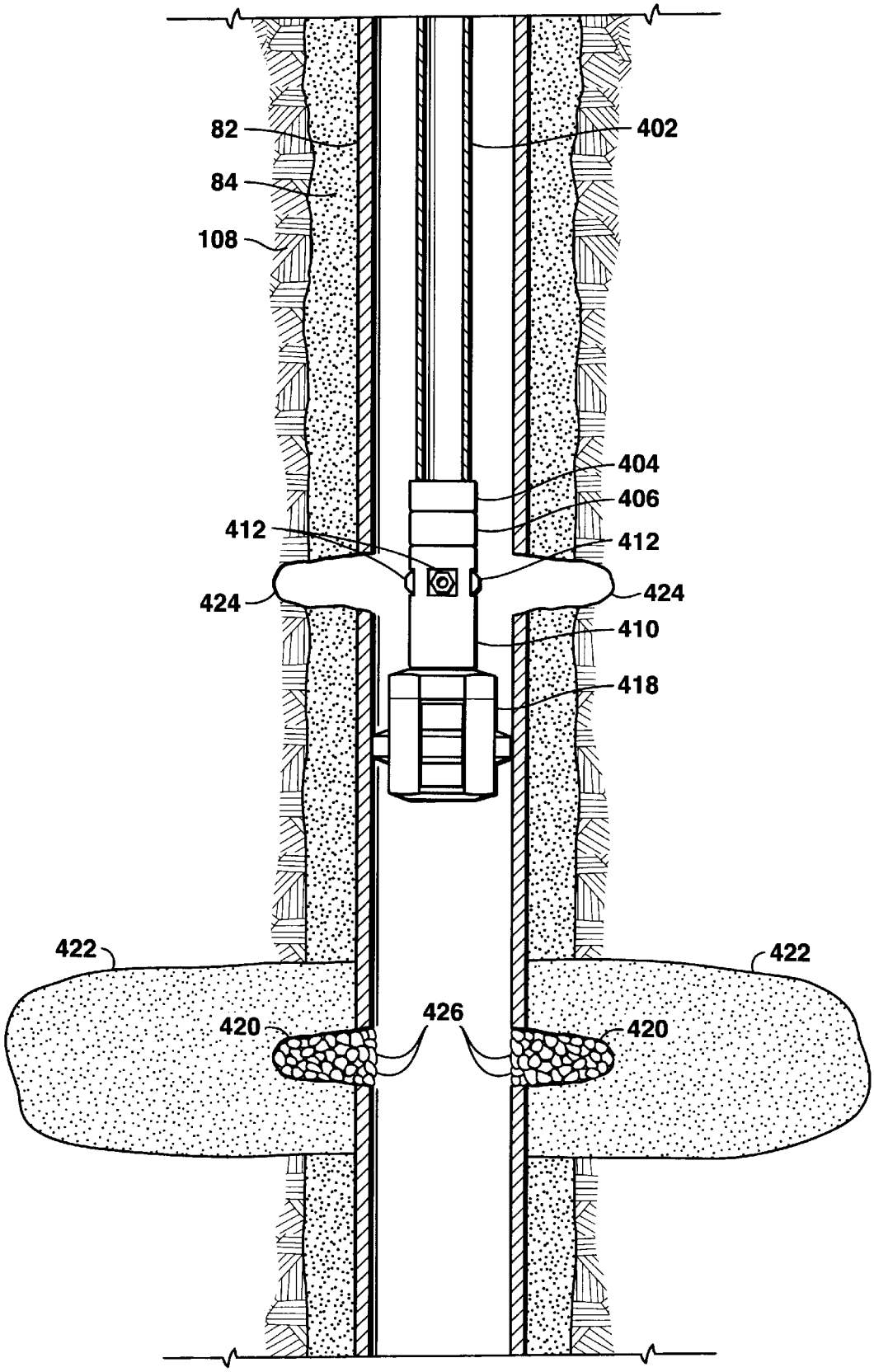
FIG. 17 represents the use of abrasive or erosive fluid-jet cutting technology for the perforating device. The perforating device consists of a jetting tool deployed on coiled tubing such that a high-pressure high-speed abrasive or erosive fluid jet used to penetrate the production casing and surrounding cement sheath to establish hydraulic communication with the desired formation interval.

FIG. 17 shows an alternative embodiment of the invention that uses abrasive (or erosive) fluid jets as the means for perforating the wellbore. Abrasive (or erosive) fluid jetting is a common method used in the oil industry to cut and perforate downhole tubing strings and other wellbore and wellhead components. The use of coiled tubing or jointed tubing provides a flow conduit for deployment of abrasive fluid-jet cutting technology. In this embodiment, use of a jetting tool allows high-pressure high-velocity abrasive (or erosive) fluid systems or slurries to be pumped downhole through the tubing and through jet nozzles. The abrasive (or erosive) fluid cuts through the production casing wall, cement sheath, and penetrates the formation to provide flow path communication to the formation. Arbitrary distributions of holes and slots can be placed using this jetting tool throughout the completion interval during the stimulation job.

In general, abrasive (or erosive) fluid cutting and perforating can be readily performed under a wide range of pumping conditions, using a wide-range of fluid systems (water, gels, oils, and combination liquid/gas fluid systems) and with a variety of abrasive solid materials (sand, ceramic materials, etc.), if use of abrasive solid material is required for the wellbore specific perforating application. Since this jetting tool can be on the order of one-foot to four-feet in length, the height requirement for the surface lubricator system is greatly reduced (by possibly up to 60 feet or greater) when compared to the height required when using conventional select-fire perforating gun assemblies as the perforating device. Reducing the height requirement for the surface lubricator system provides several benefits including cost reductions and operational time reductions.

FIG. 17 illustrates a jetting tool 410 that is used as the perforating device and coiled tubing 402 that is used to suspend the jetting tool 410 in the wellbore. In this embodiment, a mechanical casing-collar-locator 418 is used for BHA depth control and positioning; a one-way full-opening flapper-type check valve sub 404 is used to ensure fluid will not flow up the coiled tubing 402; and a combination shear-release fishing-neck sub 406 is used as a safety release device. The jetting tool 410 contains jet flow ports 412 that are used to accelerate and direct the abrasive fluid pumped down coiled tubing 402 to jet with direct impingement on the production casing 82.

FIG. 17 shows the jetting tool 410 has been used to place perforations 420 to penetrate the first formation interval of interest; that the first formation interval of interest has been stimulated with hydraulic fractures 422; and that perforations 420 have then been hydraulically sealed using particulate diverter 426 as the diversion agent. FIG. 17 further shows the jetting tool 410 has then been used to place perforations 424 in the second formation interval of interest such that perforations 424 may be stimulated with the second stage of the multi-stage hydraulic proppant fracture treatment. The embodiments discussed can be applied to multiple stage hydraulic or acid fracturing of multiple zones, multiple stage matrix acidizing of multiple zones, and treatments of vertical, deviated, or horizontal wellbores. For example, the invention provides a method to generate multiple vertical (or somewhat vertical fractures) to intersect horizontal or deviated wellbores. Such a technique may enable economic completion of multiple horizontal or deviated wells from a single location, in fields that would otherwise be uneconomic to develop.

One of the benefits over existing technology is that the sequence of zones to be treated can be precisely controlled since only the desired perforated interval is open and in hydraulic communication with the formation. Consequently, the design of individual treatment stages can be optimized before pumping the treatment based on the characteristics of the individual zone. For example, in the case of hydraulic fracturing, the size of the fracture job and various treatment parameters can be modified to provide the most optimal stimulation of each individual zone.

The potential for sub-optimal stimulation, because multiple zones are treated simultaneously, is greatly reduced. For example, in the case of hydraulic fracturing, this invention may minimize the potential for overflush or sub-optimal placement of proppant into the fracture.

Another advantage of the invention is that several stages of treatment can be pumped without interruption, resulting in significant cost savings over other techniques that require removal of the perforating device from the wellbore between treatment stages.

In addition, another major advantage of the invention is that risk to the wellbore is minimized compared to other methods requiring multiple trips; or methods that may be deployed in a single-trip but require more complicated downhole equipment which is more susceptible to mechanical failure or operational upsets. The invention can be applied to multi-stage treatments in deviated and horizontal wellbores and ensures individual zones are treated with individual stages. Typically, other conventional diversion technology in deviated and horizontal wellbores is more challenging because of the nature of the fluid transport of the diverter material over the long intervals typically associated with deviated or horizontal wellbores. For horizontal and significantly deviated wellbores, one possible embodiment would be the use of a combination of buoyant and non-buoyant ball sealers to enhance seating in all perforation orientations.

The process may be implemented to control the desired sequence of individual zone treatment. For example, if concerns exist over ball sealer material performance at elevated temperature and pressure, it may be desirable to treat from top to bottom to minimize the time duration that ball sealers would be exposed to the higher temperatures and pressures associated with greater wellbore depths. Alternatively, it may be desirable to treat upward from the bottom of the wellbore. For example, in the case of hydraulic fracturing, the screen-out potential may be minimized by treating from the bottom of the wellbore towards the top. It may also be desirable to treat the zones in order from the lowest stress intervals to the highest stress intervals. An alternative embodiment is to use perforating nipples such that ball sealers would protrude less far or not at all into the wellbore, allowing for greater flexibility if movement of the perforating gun past already-treated intervals is desired.

In addition to ball sealers, other diversion materials and methods could also be used in this application, including but not limited to particulates such as sand, ceramic material, proppant, salt, waxes, resins, or other organic or inorganic compounds or by alternative fluid systems such as viscosified fluids, gelled fluids, foams, or other chemically formulated fluids; or using limited entry methods.

To further illustrate an example multi-stage hydraulic proppant fracture stimulation using a wireline-conveyed select-fire perforating gun system deployed as the perforating device with ball sealers deployed as the diversion agent, the equipment deployment and operations steps are as follows:

1. The well is drilled and the production casing cemented across the interval to be stimulated.
2. The target zones to be stimulated within the completion interval are identified by common industry techniques using open-hole and/or cased-hole logs.
3. A reel of wireline is made-up with a select-fire perforating gun system.
4. The wellhead is configured for the hydraulic fracturing operation by installation of appropriate flanges, flow control valves, injection ports, and a wireline isolation tool, as deemed necessary for a particular application.
5. The wireline-conveyed perforating system would be rigged-up onto the wellhead for entry into the wellbore using an appropriately sized lubricator and wireline "blow-out-preventors" suspended by crane.
6. The perforating gun system would then be run-in-hole and located at the correct depth to place the first set of charges directly across the first zone to be perforated.
7. A "dry-run" of surface procedures would preferably be performed to confirm functionality of all components and practice coordination of personnel activities involved in the simultaneous operations. The dry run might involve tests of radio communications during perforating and fracturing operations and exercise of all appropriate surface equipment operation.
8. With the first select-fire perforating gun located directly across from the first zone to be perforated, the production casing would be perforated at overbalanced conditions. After perforating, the pump trucks would be brought on line and the first stage of the hydraulic fracture proppant stimulation treatment pumped into the first set of perforations. This step may also provide data on the pressure response of the formation under over-balanced perforating conditions such that when ball sealers are deployed and seated, the pressure in the wellbore should be maintained above the pressure that existed immediately prior to ball seating to ensure balls do not come off seat when perforating the next zone (which could possibly be at lower pressure). If differential sticking of the gun does occur during this perforating event, future perforating may be done with the gun oriented for depth correction several feet above or below the desired perforating interval. The wireline could then be moved up- or down-hole at approximately 10 to 15 ft/min. As the casing collar locator on the perforating tool reaches the correct depth for perforating across the zone, the gun is fired while moving and the gun is allowed to continue moving up- or down-hole until it is past the perforations.

9. Upon completion of the final stimulation stage, the wireline and gun system is removed from the wellbore and production would preferably be initiated from the stimulated zones as soon as possible. A major beneficial attribute of this method is that in the event of upsets during the job, it is possible to temporarily terminate the treatment such that the ability to treat remaining pay is not compromised. Such upsets may include equipment failure, personnel error, or other unanticipated occurrences. In other multi-stage stimulation methods where perforations are placed in all intervals prior to pumping the stimulation fluid, if a job upset condition is encountered that requires the job to be terminated prematurely, it may be extremely difficult to effectively stimulate all desired intervals.

For this example multi-stage hydraulic proppant fracture stimulation using a wireline-conveyed select-fire perforating gun system deployed as the perforating device with ball sealers deployed as the diversion agent, the following discussion below defines boundary conditions for response to various treatment conditions and events that if encountered, and not mitigated effectively during the treatment could lead to sub-optimal stimulation. To minimize the potential for rate and pressure surges associated with downhole ball seating, field testing has indicated that the gun should be fired as soon as a sufficiently large pressure rise is achieved and without reduction of injection rate or pressure. For example, in a field test of the new invention in which good diversion was inferred based on post-stimulation logs, the treatment data showed that pressure rises (associated with downhole ball sealer arrival and seating) on the order of 1,500 to 2,000 psi occur over just a few (generally about 5 to 10) seconds, with the select-fire gun positioned at the next zone then being fired as soon as this large nearly-instantaneous pressure rise is observed.

An observed pressure response of lesser magnitude, or of longer time duration, may suggest that perforations are not being optimally sealed. During any specific job, it typically will not be possible to clearly identify the mechanism associated with less than optimal sealing since several potential mechanisms may exist, including any or all of the following: (a) not all of the ball sealers are transported downhole; (b) some ball sealers come off seat during the job and do not re-seat; (c) some ball sealers fail during the job; and/or (d) perforation hole quality is poor, causing incomplete sealing.

However, by continuing with the next treatment stage, and injecting additional excess ball sealers at the end of the next stage, it may be possible to effectively mitigate the "unknown" upset condition without substantially compromising treatment effectiveness. The actual number of excess ball sealers that may be injected would be determined by on-site personnel based on the actual treatment data. It is noted that this decision (regarding the actual number of excess ball sealers to inject) may need to be made within approximately 4 to 10 minutes, since this may be the typical elapsed time between the perforating and ball injection events.

One preferred strategy for executing the treatment is to categorize each perforated interval as either a high-priority zone or a lower-priority zone based on an interpretation of the open- and cased-hole logs along with the individual well costs and stimulation job economics. Then, if incomplete ball sealing is observed in a given stage (where incomplete ball sealing may be defined in terns of observed vs. anticipated pressure rise based on the number of perforations and pump rate or by comparison of pressure responses before and after perforating) it may be desirable to continue the job for at least one more stage in an attempt to re-establish ball sealing. If the next two zones above the poorly sealed stage were designated high-priority zones, excess ball sealers would be injected in the next stage, and if incomplete ball seating were observed again, the job would preferably be terminated. If good sealing were re-established, the job would preferably be continued.

If, however, the next zone above the initial poorly sealed stage were a lower-priority zone, excess ball sealers would be injected into the next stage. Even if this next stage is also poorly sealed and incomplete ball seating is observed, the job could be continued and excess ball sealers may again be injected into a third stage. If after these two follow-up attempts, good sealing were still not re-established, the job would preferably be terminated.

A protocol like the one described above could be used to maximize the number of high priority zones that are stimulated with good ball sealing of previous zones, without necessarily discontinuing the treatment if a zone experiences sealing difficulties. Decisions for a specific treatment job would need to be based on the economic considerations specific to that particular job. Post-treatment diagnostic logs may be used to analyze the severity and impact of any difficulties during treatment.

In the event on-site personnel believe (as inferred from treatment data) some perforation charges have misfired to the extent that treatment execution may be compromised (due to too high pressures or rate limitations), a strategy similar to the following can be adopted for executing the treatment. An additional gun may be fired into the perforated zone of concern, and excess ball sealers may be injected for that stage. If it is believed that perforation charges on the second select-fire gun may have misfired to the extent that treatment execution may be compromised, the treatment would be terminated and the guns removed from the hole for inspection.

In the event a select-fire gun does not fire (as determined from the treatment pressure response, the circuit response, the audible indicator, or line movement) a strategy similar to the following can be adopted for executing the treatment. If the failure occurs early in the job, the pumping operations may be continued as determined by on-site personnel. The guns could be brought to surface and inspected. Depending on the results of the gun inspection and the treatment response with continued pumping operations, new guns could be configured and run into the well with the treatment then continued. If the failure occurs late in the job, the job may be terminated. Preferably a bridge plug or some mechanical sealing device would be set to facilitate treatment of subsequent stages.

The above methods provide a means to facilitate performing economically viable stimulation treatments in light of operational upsets or sub-optimal downhole events that may occur and could compromise the treatment if left unmitigated.

Given the multiple simultaneous operations associated with the new invention and the fact that a perforating device is hung in the wellbore during pumping of the stimulation fluids, there are several risks associated with this operation that may not typically be encountered with other multi-stage stimulation methods. Certain design and implementation steps can be used to minimize the potential for operational upsets during the job due to these incremental risks. The following examples will be based on design parameters for a 7-inch casing and 2⅝ inch perforating guns. Use of an isolation tool to protect the wireline from direct impingement of proppant, use of 5/16-inch wireline with preferably a double layer of thirty 1.13 mm diameter armor cabling, and maintaining the fluid velocity below typical erosional limits (approximately 180 ft/sec) will all minimize the risk of wireline failure due to erosion. Field tests indicate that wireline is not affected by proppant when pumping at rates less than approximately 30 to 40 bpm. Likewise wireline failure due to loading of gel and proppant can be prevented by selecting appropriate wireline strengths, maintaining tension within prudent engineering limits, and ensuring that equipment is made up and connected following appropriate practices (e.g. preferably using a fresh set rope socket). Use of at least 5/16-inch wireline with 11,000-lb breaking strength and 5,500-lb maximum suggested working tension is recommended assuming a combined cable and tool weight of about 1,700 lbs. The wireline weight indicator should be monitored so that the maximum tension is not exceeded. Pump rates can be slowed or stopped as necessary to control tension. In the event of a failure, fishing and possibly use of a coiled tubing unit for washover if the hardware is covered in proppant may be necessary.

Another concern is the potential for differential sticking of the gun during or immediately following perforating, which can be mitigated by using offset phasing of charges on gun, using stand-off rings or other positioning devices if needed, or firing the gun while moving the wireline. Should sticking occur, the treatment pumping rate and pressure can be reduced until the gun is unstuck, or if the gun remains stuck, the job can be aborted and the well flowed back to free the gun. Using this invention allows stopping treatment at almost anytime with minimal impact on the remainder of the well. Under various scenarios, this could mean stopping after perforating an interval with or without treating that interval and with or without deploying any diversion agent.

When using ⅞-inch diameter ball sealers between a 2⅝-inch diameter perforating gun and a 6-inch internal diameter casing, there may be risk of bridging ball sealers between the casing and the gun, however, maintaining a gap width between the gun and casing wall somewhat greater than the external diameter of the ball sealers will significantly reduce this risk. Also, the ball sealers are generally comprised of weaker material than the perforating gun and would probably deform if the gun were pulled free. Another potential concern would be bridging of gel and/or proppant with the perforating gun in the wellbore, but the risk can be mitigated by using computer control of proppant and/or chemicals to minimize potential material spikes. Other remedial actions for these situations would include flowing or pumping on the well, waiting for the gel to break, pulling out of the rope socket, fishing the gun out of the hole, and if necessary, mobilizing a coiled tubing unit for washover operations.

Although there is some risk of gun sticking and a resulting wireline failure, even a 2⅝-inch gun has been run using a 2⅞-inch ID wellhead isolation tool after the fracture treatment. Recommended procedures include tripping the perforating gun uphole at 250 to 300 feet per minute to "wash" proppant off the tool and reduce the risk of sticking. Pumping into the wellhead isolation tool to wash over the gun may be necessary to move it fully into the lubricator.

Another concern with this technique would be that perforating gun performance would be affected by wellbore conditions. Assuming that effective charge penetration could be compromised by the presence of proppant and the overbalanced pressure in the wellbore, a preferred practice would be to use a lower viscosity fluid such as 2% KCl water to provide a wellbore flushing procedure after pumping the proppant stages. Other preferred practices include moving the perforating gun to promote decentralization if magnetic positioning devices are used and having contingency guns available on the tool string to allow continuing with the job after an appropriate wait time if a gun misfires. If desired, the treatment could be halted in the event of suspected perforating gun misfiring without the risks to the wellbore that would result from conventional ball-sealer diversion methods.

Although desirable from the standpoint of maximizing the number of intervals that can be treated, the use of short guns (i.e., 4-ft length or less) could limit well productivity in some instances by inducing increased pressure drop in the near-wellbore reservoir region when compared to use of longer guns. Potential for excessive proppant flowback may also be increased leading to reduced stimulation effectiveness. Flowback would preferably be performed at a controlled low-rate to limit potential proppant flowback. Depending on flowback results, resin-coated proppant or alternative gun configurations could be used to improve the stimulation effectiveness.

In addition, to help mitigate potential undesirable proppant erosion on the wireline cable from direct impingement of the proppant-laden fluid when pumped into the injection ports, a "wireline isolation device" can be rigged up on the wellhead. The wireline isolation device consists of a flange with a short length of tubing attached that runs down the center of the wellhead to a few feet below the injection ports. The perforating gun and wireline are run interior to this tubing. Thus the tubing of the wireline isolation device deflects the proppant and isolates the wireline from direct impingement of proppant. Such a wireline isolation device could consist of nominally 3-inch to 3½-inch diameter tubing such that it would readily allow 1 11/16-inch to 2⅝-inch perforating guns to be run interior to this device, while still fitting in 4½-inch diameter or larger production casing and wellhead equipment. Such a wireline isolation device could also contain a flange mounted above the stimulation fluid injection ports to minimize or prevent stagnant (non-moving) fluid conditions above the treatment fluid injection port that could potentially act as a trap to buoyant ball scalers and prevent some or all of the ball sealers from traveling downhole. The length of the isolation device would be sized such that in the event of damage, the lower frac valve could be closed and the wellhead rigged down as necessary to remove the isolation tool. Depending on the stimulation fluids and the method of injection, a wireline isolation device would not be needed if erosion concerns were not present.

Although field tests of wireline isolation devices have shown no erosion problems, depending on the job design, there could be some risk of erosion damage to the isolation tool tubing assembly resulting in difficulty removing it. If an isolation tool is used, preferred practices would be to maintain impingement velocity on the isolation tool substantially below typical erosional limits, preferably below about 180 ft/sec, and more preferably below about 60 ft/sec.

Another concern with this technique is that premature screen-out may occur if perforating is not timed appropriately since it is difficult to initiate a fracture with proppant-laden fluid across the next zone. It may be preferable to use a KCl fluid for the pad rather than a cross-linked pad fluid to better initiate fracturing of the next zone. Pumping the job at a higher rate with 2% KCl water between stages to achieve turbulent flush/sweep of casing or using quick-flush equipment will minimize the risk of proppant screenout. Also, contingency guns available on the tool string would allow continuing the job after an appropriate wait time.

Similarly overflush of the previous zone may occur if ball sealing is problematic or if perforating is not timed appropriately. Pumping the job at a higher rate with a KCl fluid pad to achieve turbulent flush/sweep of casing may help prevent overflush. Using the results and data from previous stages to assess timing and pump volumes associated with ball arrival downhole would allow adjustments to be made to improve results.

While use of buoyant ball sealers is preferred, in some applications the treatment fluid may be of sufficiently low density such that commercially available ball sealers are not buoyant; in these instance non-buoyant ball sealers could be used. However, depending on the specific treatment design, perforation seating and sealing of non-buoyant ball sealers can be problematic. The present invention allows for the possibility of dropping excess non-buoyant ball sealers beyond the number of perforations to be sealed to ensure that each individual set of perforations is completely sealed. This will prevent subsequent treatment stages from entering this zone, and the excess non-buoyant ball sealers can fall to the bottom of the well and not interfere with the remainder of the treatment. This aspect of the invention allows for the use of special fracturing fluids, such as nitrogen, carbon dioxide or other foams, which have a lower specific gravity than any currently available ball sealers.

A six-stage hydraulic proppant fracture stimulation treatment has been successfully completed with all six stages pumped as planned. The first zone of this job was previously perforated, and a total of six select-fire guns were fired during the job. Select-fire Guns 1 through 5 were configured for 16 shots at 4 shots per foot (spf) with alternating phasing between shots of −7.5°, 0°, and +7.5° to reduce potential for gun-sticking. Select-fire Gun 6 was a spare gun (16 shots 2 spf) run as a contingency option for potential mitigation of a premature screen-out if it were to occur, and it was fired prior to removal from the wellbore for safety reasons.

During the time period associated with the first and second ball injection and perforation events, minor pumping upsets occurred with the quick-flush operation (and were resolved during later stages of the treatment). The perforating gun became differentially stuck during two of the treatment stages, and both times it was "unstuck" by reducing the injection rate. The post-job gun inspection indicated that one charge on the fourth and three charges on each of the fifth and sixth select-fire perforating guns did not fire.

During the third ball injection event and perforation of the fourth interval, the pressure rise was not as pronounced as in the previous events, suggesting that some perforations were not entirely sealed with ball sealers. Another plausible explanation for this reduced pressure response is that previously squeezed perforations may have broken down during the previous stage (and this conjecture was supported by the post-treatment temperature log). During this event, the upsets with the quick-flush operation were eliminated.

A temperature log obtained approximately 5 hours following the fracture stimulation suggests that all zones were treated with fluid as inferred by cool temperature anomalies (as compared to a base temperature survey obtained prior to stimulation activities) present at each perforated interval. Furthermore, the log data suggest the possibility that previously squeezed perforations broke down during the fracture treatment and received fluid, providing a potential explanation for the pressure anomaly observed during the third stage of operations. The log was run with the well shut-in after earlier flowing back approximately a casing volume of frac fluid. Proppant fill prevented logging the deepest set of perforations.

During this stimulation treatment a total of 109 0.9-specific gravity rubber-coated phenolic ball sealers were injected to seal 80 intended perforations. The ball sealers were selected for use prior to the job by testing their performance at approximately 8,000-psi. Of the 91 ball sealers recovered after the treatment; a total of 70 ball sealers had clearly visible perforation indentations (with several possessing possible multiple perforation markings) indicating that they successfully seated on perforations, and 4 of the ball sealers were eroded. Of the 21 ball sealers that did not have perforation markings, it is not certain whether these ball sealers actually seated or not since a very large pressure differential is necessary to place a visible and permanent indentation on the ball sealer. The eroded ball sealers indicate that treatment design should preferably allow for some failure of individual ball sealers.

Those skilled in the art will recognize that many tool combinations and diversion methodologies not specifically mentioned in the examples will be equivalent in function for the purposes of this invention.

We claim:

1. A method for treating multiple intervals of one or more subterranean formations intersected by a cased wellbore, said method comprising:

a) using a perforating device to perforate at least one interval of said one or more subterranean formations;

b) pumping a treating fluid into the perforations created in said at least one interval by said perforating device without removing said perforating device from said wellbore;

c) deploying one or more diversion agents in said wellbore to removably block further fluid flow into said perforations; and d) repeating at least steps a) through b) for at least one more interval of said one or more subterranean formations; wherein at some time after step a) and before removably blocking fluid flow into said perforations, said perforating device is moved to a position above said at least one interval perforated in step a).

2. The method of claim 1 further comprising repeating step c) for at least one more interval of said one or more subterranean formations.

3. The method of claim 1 wherein at some time after step a) and before removably blocking fluid flow into said perforations, said perforating device is moved to a position adjacent to the interval of subterranean formation desired to be perforated next.

4. The method of claim 1 wherein at some time after step a) and before removably blocking fluid flow into said perforations, said perforating device is moved to a position above the position in said wellbore at which said treating fluid enters said wellbore.

5. The method of claim 1 wherein at some time after step a) and before removably blocking fluid flow into said perforations, said perforating device is moved to a position above the position in said welibore at which said diversion agent enters said wellbore.

6. The method of claim 1 wherein said diversion agents deployed in the wellbore are ball sealers.

7. The method of claim 1 wherein diversion agents deployed in said wellbore are selected from the group of particulates, gels, viscous fluids, and foams.

8. The method of claim 1 wherein said diversion agents deployed in said wellbore is at least one mechanical sliding sleeve.

9. The method of claim 8 wherein said perforating device is additionally used to actuate said mechanical sliding sleeves.

10. The method of claim 1 wherein said diversion agent deployed in said wellbore is at least one mechanical flapper valve.

11. The method of claim 10 wherein said perforating device is additionally used to actuate said mechanical flapper valve.

12. The method of claim 1 wherein a wireline is used to suspend the perforating device in said wellbore.

13. The method of claim 12 wherein a wireline isolation device is positioned in the wellbore near the point at which said treating fluid enters said wellbore to protect said wireline from said treating fluid.

14. The method of claim 1 wherein said treating fluid is a slurry of a proppant material and a carrier fluid.

15. The method of claim 1 wherein said treating fluid is a fracturing fluid containing no proppant material.

16. The method of claim 1 wherein said treating fluid is an acid solution.

17. The method of claim 1 wherein said treating fluid is an organic solvent.

18. The method of claim 1 wherein a tubing string is used to suspend the perforating device in said wellbore.

19. The method of claim 18 wherein a tubing isolation device is positioned in said wellbore near the point at which said treating fluid enters said wellbore to protect said tubing from said treating fluid.

20. The method of claim 18 wherein said tubing string is a coiled tubing.

21. The method of claim 18 wherein said tubing string is a jointed tubing.

22. The method of claim 18 wherein said perforating device is a jet cutting device that uses fluid pumped down said tubing string to establish hydraulic communication between said wellbore and said one or more intervals of said one or more subterranean formations.

23. The method of claim 1 wherein said perforating device is a select-fire perforating gun containing multiple sets of one or more shaped-charge perforating charges.

24. The method of claim 1 wherein said wellbore has perforating charges affixed to said casing at locations corresponding to said multiple intervals of said one or more subterranean formations and said perforating device actuates at least one of said casing-conveyed charges in order to perforate at least one interval of said one or more subterranean formations.

25. The method of claim 1 wherein a tractor device is used to move said perforating device within said wellbore.

26. The method of claim 25 wherein said tractor device is actuated by an on-board computer system which also actuates said perforating device.

27. The method of claim 25 wherein said tractor device is actuated and controlled by a wireline communication.

28. A method for treating multiple intervals of one or more subterranean formations intersected by a cased wellbore, said method comprising:

a) using a select-fire perforating device containing multiple sets of one or more shaped-charge perforating charges to perforate at least one interval of said one or more subterranean formations;

b) pumping a treating fluid into the perforations created in said at least one interval by said perforating device without removing said perforating device from said wellbore;

c) deploying ball sealers in said wellbore to removably block further fluid flow into said perforations; and d) repeating at least steps a) through b) for at least one more interval of said one or more subterranean formations;

wherein at some time after step a) and before removably blocking fluid flow into said perforations, said perforating device is moved to a position above said at least one interval perforated in step a).

29. The method of claim 28 further comprising repeating step c) for at least one more interval of said one or more subterranean formations.

30. The method of claim 29 wherein said perforating device has a depth locator connected thereto for controlling the location of said perforating device in said wellbore.

31. The method of claim 29 wherein at some time after step a) and before deploying said ball sealers, said perforating device is moved to a position adjacent to the interval of subterranean formation desired to be perforated next.

32. The method of claim 29 wherein at some time after step a) and before deploying said ball sealers, said perforating device is moved to a position above the position in said wellbore at which said treating fluid enters said wellbore.

33. The method of claim 29 wherein at some time after step a) and before deploying said ball sealers, said perforating device is moved to a position above the position in said wellbore at which said ball sealers enter said wellbore.

34. The method of claim 29 wherein a wireline is used to suspend said perforating (device in said wellbore.

35. The method of claim 34 wherein a wireline isolation device is positioned in said wellbore near the point at which said treating fluid enters said wellbore to protect said wireline from said treating fluid.

36. The method of claim 34 wherein said treating fluid is a slurry of a proppant material and a carrier fluid.

37. The method of claim 34 wherein said treating fluid is a fracturing fluid containing no proppant material.

38. The method of claim 28 wherein said treating fluid is an acid solution.

39. The method of claim 28 wherein said wellbore has perforating charges affixed to said casing at locations corresponding to said multiple intervals of said one or more subterranean formations and said perforating device actuates at least one of said casing-conveyed charges in order to perforate at least one interval of said one or more subterranean formations.

40. The method of claim 28 wherein a tubing string is used to suspend the perforating device in said wellbore.

41. The method of claim 40 wherein a tubing isolation device is positioned in said wellbore near the point at which said treating fluid enters said wellbore to protect said tubing from said treating fluid.

42. The method of claim 40 wherein said tubing string is a coiled tubing.

43. The method of claim 40 wherein said tubing string is a jointed tubing.

44. The method of claim 28 wherein a tractor device is used to move said perforating device within said wellbore.

45. The method of claim 44 wherein said tractor device is actuated by an on-board computer system which also actuates said perforating device.

46. The method of claim 44 wherein said tractor device is actuated and controlled by a wireline communication.

* * * * *